US009616986B1

(12) United States Patent
Gilk et al.

(10) Patent No.: US 9,616,986 B1
(45) Date of Patent: Apr. 11, 2017

(54) ADJUSTABLE TRANSOM MOUNT

(71) Applicants: Arlon J. Gilk, Albany, MN (US); Lawrence L. Hoeschen, Freeport, MN (US); Jakob Gilk, Albany, MN (US)

(72) Inventors: Arlon J. Gilk, Albany, MN (US); Lawrence L. Hoeschen, Freeport, MN (US); Jakob Gilk, Albany, MN (US)

( * ) Notice: Subject to any disclaimer, the term of this patent is extended or adjusted under 35 U.S.C. 154(b) by 107 days.

(21) Appl. No.: 14/830,728

(22) Filed: Aug. 19, 2015

Related U.S. Application Data

(60) Provisional application No. 62/205,625, filed on Aug. 14, 2015.

(51) Int. Cl.
*B63H 20/16* (2006.01)
*B63H 20/10* (2006.01)

(52) U.S. Cl.
CPC ..... *B63H 20/106* (2013.01)

(58) Field of Classification Search
CPC ..... B63H 20/16
USPC ..... 440/63
See application file for complete search history.

(56) References Cited

U.S. PATENT DOCUMENTS

| | | | |
|---|---|---|---|
| 450,004 | A | 4/1891 | Daley |
| 486,684 | A | 11/1892 | Salisbury |
| 570,613 | A | 11/1896 | Smith |
| 682,027 | A | 9/1901 | Burgess |
| 827,202 | A | 7/1906 | Bachman |
| 904,313 | A | 11/1908 | Davis |
| 941,827 | A | 11/1909 | Trouche |
| 1,211,106 | A | 1/1917 | Doeg |
| 1,226,400 | A | 5/1917 | Smith |
| 1,335,412 | A | 3/1920 | Weaver |
| 1,479,025 | A | 1/1924 | Caille et al. |
| 1,586,517 | A | 6/1926 | Caille et al. |
| 1,831,739 | A | 11/1931 | Decker |
| 1,953,599 | A | 4/1934 | Grimes |
| 2,014,859 | A | 9/1935 | Mitchell, Jr. |
| 2,038,299 | A | 4/1936 | Kohlhagen |
| 2,096,223 | A | 10/1937 | Chandler et al. |
| 2,195,774 | A | 4/1940 | Freeman et al. |
| D138,752 | S | 9/1944 | Waterval |
| 2,442,728 | A | 6/1948 | Kiekhaefer |
| 2,487,177 | A | 11/1949 | Pollock |
| 2,513,050 | A | 6/1950 | Pugh |
| 2,528,628 | A | 11/1950 | Whitney |
| 2,537,943 | A | 1/1951 | Brown |

(Continued)

*Primary Examiner* — Lars A Olson
*Assistant Examiner* — Jovon Hayes
(74) *Attorney, Agent, or Firm* — Albert W. Watkins

(57) ABSTRACT

A transom mount has a transom mounting bracket and a leveling platform angularly adjustable relative to the transom mounting bracket. The leveling platform includes a vertical axis pintle, and a spring pin. Supported through the pintle onto the leveling platform is a carousel including rotary limit holes and a travel lock hole. The carousel generally spins freely about the pintle. However, when the spring pin is aligned with these carousel holes, it will automatically lock the carousel relative to the leveling platform. Supported on the carousel is a bell housing or other equivalent support having an engine coupling flange on one end and a long shaft coupler on the other. A set of tilt stop holes may be provided in combination with a tilt stop pin to control the maximum tilt of the bell housing and mud motor drive.

14 Claims, 21 Drawing Sheets

(56) References Cited

U.S. PATENT DOCUMENTS

| | | | | |
|---|---|---|---|---|
| 2,549,477 | A | 4/1951 | Kiekhaefer | |
| 2,549,484 | A | 4/1951 | Kiekhaefer | |
| 2,595,863 | A | 5/1952 | Loofbourrow | |
| 2,656,812 | A | 10/1953 | Kiekhaefer | |
| 2,860,594 | A | 11/1958 | Kiekhaefer | |
| 2,896,565 | A | 7/1959 | Stevens | |
| 2,996,035 | A | 8/1961 | Torrey | |
| 3,131,940 | A | 5/1964 | Ertaud | |
| 3,131,942 | A | 5/1964 | Ertaud | |
| 3,150,822 | A | 9/1964 | Dreyfus et al. | |
| 3,151,597 | A | 10/1964 | Larsen | |
| 3,331,101 | A | 7/1967 | Thomas, Jr. | |
| 3,355,179 | A | 11/1967 | McGrew, Jr. | |
| 3,430,603 | A | 3/1969 | Parish | |
| 3,575,477 | A | 4/1971 | Newsome | |
| 3,587,510 | A | 6/1971 | Shimanckas | |
| 3,599,595 | A | 8/1971 | James | |
| 3,622,164 | A | 11/1971 | Herbert et al. | |
| 3,752,111 | A | 8/1973 | Meynier | |
| 3,752,489 | A * | 8/1973 | Latinen | F16J 15/002 277/350 |
| 3,768,432 | A | 10/1973 | Spaulding | |
| 3,795,386 | A | 3/1974 | Carter et al. | |
| 3,797,865 | A | 3/1974 | Ballentine | |
| 3,940,150 | A | 2/1976 | Martin et al. | |
| 3,942,803 | A | 3/1976 | Wijnant et al. | |
| 4,010,960 | A | 3/1977 | Martin | |
| D259,488 | S | 6/1981 | Carter et al. | |
| 4,285,632 | A | 8/1981 | DeSalve | |
| 4,295,835 | A | 10/1981 | Mapes et al. | |
| 4,471,963 | A | 9/1984 | Airhart | |
| 4,487,152 | A | 12/1984 | Larson | |
| 4,491,374 | A | 1/1985 | Hagshenas et al. | |
| 4,549,949 | A | 10/1985 | Guinn | |
| 4,597,742 | A | 7/1986 | Finkl | |
| 4,636,175 | A | 1/1987 | Frazzell et al. | |
| 4,676,756 | A | 6/1987 | Rodrigue et al. | |
| 4,678,440 | A * | 7/1987 | Rodrigue | B63H 20/08 114/355 |
| 4,708,672 | A | 11/1987 | Bentz et al. | |
| 4,726,796 | A | 2/1988 | Rivette, Jr. et al. | |
| 4,744,779 | A | 5/1988 | Koehler | |
| 4,781,632 | A | 11/1988 | Litjens et al. | |
| 4,804,312 | A | 2/1989 | Schneekluth | |
| 4,820,212 | A | 4/1989 | McElroy et al. | |
| 4,826,461 | A | 5/1989 | Newman | |
| 4,977,847 | A | 12/1990 | Bartlett | |
| 5,207,605 | A | 5/1993 | Kroeber | |
| D356,799 | S | 3/1995 | Gardner | |
| 5,484,264 | A | 1/1996 | Karls et al. | |
| 5,556,310 | A | 9/1996 | Gandarillas | |
| 5,558,498 | A | 9/1996 | Ogino | |
| 5,667,415 | A | 9/1997 | Arneson | |
| 5,673,643 | A | 10/1997 | Poppa | |
| 5,800,224 | A | 9/1998 | Ogino | |
| 5,820,425 | A | 10/1998 | Ogino et al. | |
| 5,890,937 | A | 4/1999 | Granger | |
| 5,931,710 | A * | 8/1999 | Johnson, Sr. | B63H 5/125 440/55 |
| D416,535 | S | 11/1999 | Rudofsky | |
| 5,993,274 | A | 11/1999 | Rising et al. | |
| 6,155,893 | A | 12/2000 | Belmont | |
| 6,196,804 | B1 | 3/2001 | Lackey | |
| 6,234,854 | B1 | 5/2001 | Rydzewski | |
| 6,302,750 | B1 | 10/2001 | Foreman | |
| 6,358,008 | B1 | 3/2002 | Chen | |
| 6,361,388 | B2 | 3/2002 | Foreman | |
| 6,482,057 | B1 * | 11/2002 | Schoell | B63H 5/125 440/53 |
| 6,524,069 | B2 | 2/2003 | Chen | |
| 6,571,653 | B1 | 6/2003 | Takeda et al. | |
| 6,966,806 | B1 | 11/2005 | Bruestle et al. | |
| 7,008,279 | B2 | 3/2006 | Ide et al. | |
| 7,048,600 | B1 * | 5/2006 | Broussard | B63H 20/00 440/53 |
| 7,052,340 | B1 | 5/2006 | Broussard | |
| 7,056,092 | B2 | 6/2006 | Stahl | |
| D527,021 | S | 8/2006 | Osumi | |
| 7,223,076 | B2 | 5/2007 | Mansson | |
| 7,297,035 | B2 | 11/2007 | Broussard | |
| 7,335,074 | B2 | 2/2008 | Arneson | |
| 7,387,553 | B1 | 6/2008 | Misorski et al. | |
| 7,392,988 | B2 | 7/2008 | Moldt et al. | |
| 7,488,225 | B2 | 2/2009 | Lin | |
| 7,575,490 | B1 | 8/2009 | Angel et al. | |
| 7,637,792 | B1 | 12/2009 | Davis et al. | |
| D608,371 | S | 1/2010 | Perkins, II | |
| 7,717,678 | B2 | 5/2010 | Chen | |
| 7,946,591 | B2 | 5/2011 | Pabst et al. | |
| D670,228 | S | 11/2012 | Gilk et al. | |
| D670,229 | S | 11/2012 | Gilk et al. | |
| 8,302,549 | B2 | 11/2012 | Templeman et al. | |
| D682,186 | S | 5/2013 | Gilk et al. | |
| 8,911,272 | B1 | 12/2014 | Gilk et al. | |
| 2001/0031586 | A1 | 10/2001 | Fisher | |
| 2003/0152461 | A1 | 8/2003 | Heidenreich | |
| 2010/0032545 | A1 * | 2/2010 | Bernloehr | B63H 20/08 248/640 |

* cited by examiner

ADJUSTABLE TRANSOM MOUNT

CROSS REFERENCE TO RELATED APPLICATIONS

The present application claims the benefit of U.S. provisional patent application 62/205,625 filed Aug. 14, 2015 of like title and inventorship, the teachings and entire contents which are incorporated herein by reference.

BACKGROUND OF THE INVENTION

1. Field of the Invention

The present invention pertains to marine propulsion systems generally, and more specifically to marine propulsion systems utilizing an elongated propeller drive shaft having a housing commonly referred to as a drive tube surrounding the propeller shaft.

2. Description of the Related Art

Modern marine vehicles are most commonly powered by an internal combustion engine mounted within the boat or above the water line adjacent the boat. The mechanical power generated by the engine is transferred through a drive shaft to a water propulsion device such as a propeller. These marine vehicles provide a mode of transportation for traversing bodies of water that may be relatively large and open, such as the larger lakes, rivers and oceans, or relatively smaller, such as streams or creeks, swamps, glades, savannahs and the like.

For boating in open waterways such as lakes, rivers, or oceans, the propeller shaft is typically relatively short, and may extend from the motor and away from the boat hull only a few inches or feet. The spacing between propeller and hull in this type of boat is substantially smaller than the overall length of the boat. This short propeller shaft also dictates that the propeller is placed fairly deep into the water, to allow water to circulate past the boat hull and reach the propeller, and to avoid interference between propeller and boat hull during turns and the like. In open waters, where few if any obstacles exist, this arrangement has proven to be very effective and is represented by standard inboard and outboard marine propulsion systems.

Unfortunately, when traversing smaller or shallower bodies of water, such as swamps, creeks and streams, the rounded boat hulls and deep propeller arrangements used in open waterways are no longer effective or useful. The hull runs deeper than some sections of these smaller waterways, or obstacles present therein, and the propeller readily becomes tangled in vegetative matter, or, worse, may be destroyed by the obstacles. Particularly for those applications where the water is either shallow or filled with many obstacles, the prior art inboard and outboard motors are generally unsatisfactory.

To traverse the shallower bodies of water or those littered with obstacles, a generally flat bottom boat hull is preferred. In addition, the propeller drive shaft is extended beyond the boat by a much greater distance. When extended, the propeller can be driven shallowly in the water, free of interference with the boat. When an obstacle is encountered, the boat may pass over and be clear of the obstacle while still being propelled by the motor. Boats that use this type of drive system are sometimes referred to as mud boats, owing to their substantially improved propulsion in shallow waters, swamps, and other muddy waters. A number of US patents are illustrative of the prior art, the contents and teachings of each which are incorporated herein by reference, including U.S. Pat. No. 941,827 by Trouche, entitled "Motor more especially applicable for driving barges, wherries, flatboats, and the like"; U.S. Pat. No. 1,953,599 by Grimes, entitled "Boat propulsion device"; U.S. Pat. No. 2,096,223 by Chandler et al, entitled "Boat propelling mechanism"; U.S. Pat. No. 3,752,111 by Meynier, entitled "Pivoting motor boat drive unit"; U.S. Pat. No. 4,676,756 by Rodrigue et al, entitled "Boat and propulsion system including a transom platform"; U.S. Pat. No. 4,678,440 by Rodrigue et al, entitled "Boat and propulsion system"; and U.S. Pat. No. 8,911,272 by Gilk et al, entitled "Long Shaft Propeller Controller and Bearing Seal Protector".

On propulsion systems having an extended drive shaft, there are a number of optional, but typically preferred additional features. For example, it is commonplace to use a housing or casing to surround the drive shaft, commonly referred to as a drive tube. Frequently, some type of shroud or structure such as a skag is also provided to prevent the propeller from directly striking any obstacles, and instead deflect the drive tube, drive shaft and propeller away from the obstacle. Additional features may be associated with the propeller and drive tube, such as various reinforcing elements, stiffeners or frameworks. The drive tube isolates the rotating propeller shaft from people and objects, thereby preventing the shaft from entangling or harming people or objects. The drive tube also protects the shaft from impact with hazards, and provides additional structural support to the drive shaft.

These long shaft drive systems commonly use a vertical axis pivot about which the long shaft and motor spin. This rotation allows the direction of propulsion to be varied. Commonly, the motor is balanced on one side of this vertical axis, and the long shaft, drive tube, shroud, and the like are on the opposite side. This balance also allows a horizontal axis pivotal coupling to be used at or near the balance point, and then the propeller can be raised or lowered relative to the water surface much like a children's see-saw in a playground.

One challenge associated with these long shaft drive systems is the variability in boat hull and transom design. A transom is the surface that forms the stern, or back, of the boat. The transom may be oriented in a vertical plane, but in most cases the transom will be raked aft, meaning the transom is typically either 12 or 16 degrees from vertical, with the bottom of the transom more forward or towards the bow than the top of the transom. In some less common designs, commonly referred to as a reverse transom, the bottom of the transom may instead be more rearward (aft) or farther from the bow than the top of the transom. Furthermore, transoms may be flat or curved transverse to the longitudinal axis of the boat, meaning that they may extend either more fore or more aft at the top center of the transom than at the top sides of the transom. In summary, transoms may be shaped very differently from one boat to the next. As a result, it is quite difficult to provide a single mounting system adaptable to the wide variety of transoms.

Not only is the transom variable from one boat to the next, hull designs are also often unique. Different hull designs and even different loading will create different patterns of water flow around the boat. Depending upon the boat hull, loading, and speed of travel, this can be quite important, since a wake is commonly created behind the boat with a crest of highly aerated water. A propeller is extremely inefficient in highly aerated water, and so it is very desirable to run the propeller in less disturbed water whenever possible.

Another challenge with long shaft drives is that many propeller mounts preferably have a vertical shaft that allows the engine and long shaft propeller to rotate freely. For typical use and operation, this is very desirable, since the operator will control the direction and elevation of the shaft to best move the boat through the water. Furthermore, and as noted above, when the long shaft or propeller shrouds encounter a submersed obstacle, it is also preferable to allow the shaft to move relatively freely to pass the obstacle without harm.

Unfortunately, the variability of the transom geometry and tilt from one boat to the next will lead prior art transom mounts to tilt at angles significantly offset from the desired vertical position. One serious drawback associated with the axis of rotation being offset from actual vertical is that, when turning a corner, the engine will tilt from side to side, essentially rotating or leaning around the propeller shaft axis. The normal roll about the horizontal axis which controls the height of the prop in the water, transverse to the propeller shaft axis, does not adversely affect engine lubrication and performance. However, if the engine rolls about the propeller shaft axis, the engine can run dry and be damaged.

In addition to the foregoing patents, Webster's New Universal Unabridged Dictionary, Second Edition copyright 1983, is incorporated herein by reference in entirety for the definitions of words and terms used herein.

SUMMARY OF THE INVENTION

In a first manifestation, the invention is a transom mount configured to support a long shaft drive upon a boat transom. A transom mounting bracket is configured to affix to the boat transom. A leveling platform is angularly adjustable relative to the transom mounting bracket. A fastener selectively secures the leveling platform to the transom mounting bracket. The leveling platform includes a pintle. A carousel is supported through the pintle onto the leveling platform.

In a second manifestation, the invention is, in combination, a boat hull, a long shaft drive, and a transom mount configured to support the long shaft drive upon the boat hull. The boat hull has a transom. The long shaft drive has an engine, a long shaft propeller, and a pivotal support generally balanced between the engine and long shaft propeller. The transom mount has a transom mounting bracket configured to affix to the boat transom. A leveling platform is angularly adjustable relative to the transom mounting bracket. A fastener selectively secures the leveling platform to the transom mounting bracket. The leveling platform includes a pintle. A carousel is supported through the pintle onto the leveling platform. The carousel and pintle support the long shaft drive upon the leveling platform.

In a third manifestation, the invention is a transom mount having a transom mounting bracket and a leveling platform angularly adjustable relative to the transom mounting bracket. The leveling platform includes a pintle, and a spring pin. Supported through the pintle onto the leveling platform is a carousel including rotary limit holes and a travel lock hole. The carousel generally spins freely about the pintle. However, when the spring pin is aligned with these carousel holes, it will automatically lock the carousel relative to the leveling platform. Supported on the carousel are a pair of spaced apart long shaft drive supporting plates. These long shaft drive supporting plates through a long shaft drive horizontal pivot support a bell housing having an engine coupling flange on one end and a long shaft coupler on the other.

OBJECTS OF THE INVENTION

Exemplary embodiments of the present invention solve inadequacies of the prior art by providing a transom mount having a transom mounting bracket and a leveling platform angularly adjustable relative to the transom mounting bracket. The leveling platform includes a pintle, and a spring pin. Supported through the pintle onto the leveling platform is a carousel including rotary limit holes and a travel lock hole. The carousel generally spins freely about the pintle. However, when the spring pin is aligned with these carousel holes, it will automatically lock the carousel relative to the leveling platform. Supported on the carousel are a pair of spaced apart long shaft drive supporting plates. These long shaft drive supporting plates through a long shaft drive horizontal pivot support a bell housing having an engine coupling flange on one end and a long shaft coupler on the other. A set of tilt stop holes may be provided in combination with a tilt stop pin to control the maximum tilt of the bell housing and long shaft drive.

The present invention and the preferred and alternative embodiments have been developed with a number of objectives in mind. While not all of these objectives are found in every embodiment, these objectives nevertheless provide a sense of the general intent and the many possible benefits that are available from embodiments of the present invention.

A first object of the invention is to provide a boat hull and motorized drive system adapted to traverse shallow bodies of water and those littered with obstacles. A second object of the invention is to pass over and be clear of obstacles while still being propelled by the motor. Another object of the present invention is to balance a motor and long shaft propeller on opposite sides of a pivot. A further object of the invention is to provide a vertical axis pintle about which the pivot, motor, and long shaft propeller can rotate. Yet another object of the present invention is to enable the vertical axis pintle to be properly vertically aligned through a wide range of boat hull and transom geometries and transom rakes. An additional object of the invention is to enable a transom mount to couple in either inboard or outboard configuration, to allow a boat operator to choose which position provides more desirable operating characteristics. A further object of the present invention is to prevent engine tilt about the propeller shaft axis, while enabling engine tilt transverse to the propeller shaft axis. An additional object of the invention is to provide rotational limits for the motorized drive system that independently limit the depth of the propeller and also safely control orientation of the long shaft about a vertical axis. Another object of the invention is to provide secure transom mounting while also enabling ready removal of the long shaft drive from the boat hull. A further object of the invention is to facilitate securing many diverse mounting geometries known in long shaft drive industry.

BRIEF DESCRIPTION OF THE DRAWINGS

The foregoing and other objects, advantages, and novel features of the present invention can be understood and appreciated by reference to the following detailed description of the invention, taken in conjunction with the accompanying drawings, in which.

DESCRIPTION OF THE PREFERRED EMBODIMENT

Figure 1:
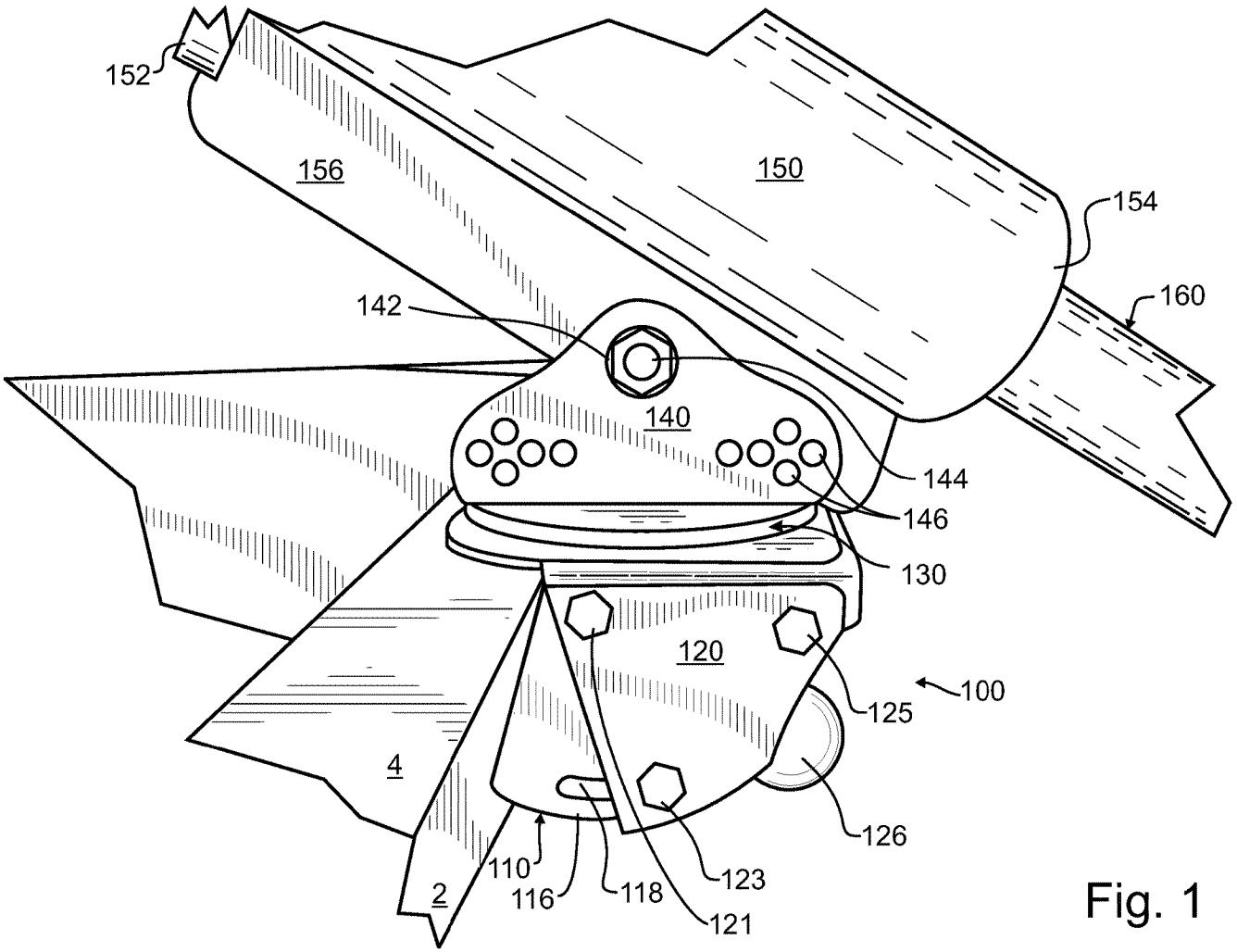
FIG. 1 illustrates a preferred embodiment transom mount in combination with a boat hull, transom, bell housing, and long shaft propeller designed in accord with the teachings of the present invention from a side elevational and projected view.

Manifested in the preferred embodiment, the present invention provides a transom mount uniquely adaptable to a wide variety of transoms and boat hull designs, that provides a number of beneficial features for safety and convenience. In a preferred embodiment of the invention illustrated in FIGS. 1-9, a preferred embodiment transom mount 100 is mounted to a boat hull transom 2. Preferred embodiment transom mount 100 supports a bell housing 150 thereupon that provides an engine coupling flange 152 on one end adapted for bolting or otherwise affixing a drive engine, and a long shaft propeller coupler 154 on the other for securely coupling and supporting a long shaft propeller and shroud 160.

FIG. 1 illustrates an exemplary prior art boat transom 2 and gunwale 4 to which the preferred embodiment transom mount 100 may be affixed. While in some circles a gunwale will be defined somewhat more narrowly to indicate only the tops of the port and starboard sides of a boat, gunwale is defined herein to include the top portion or cap of the transom as well. Transom mounting bracket 110 preferably is affixed securely to and immediately adjacent with the transom top, at gunwale 4. If desired, a pad, plate, reinforcement, spacer, or other apparatus may be provided between transom 2 and transom mounting bracket 110. In preferred embodiment transom mount 100, transom mounting bracket 110 is sufficiently large and strong to provide adequate support for all intended engines and transoms. However, a spacer may be used to further displace carousel 130 from transom 2, which will in turn allow greater adjustment of tightness of turns and locating the propeller in clean, unaerated water.

Figure 4:
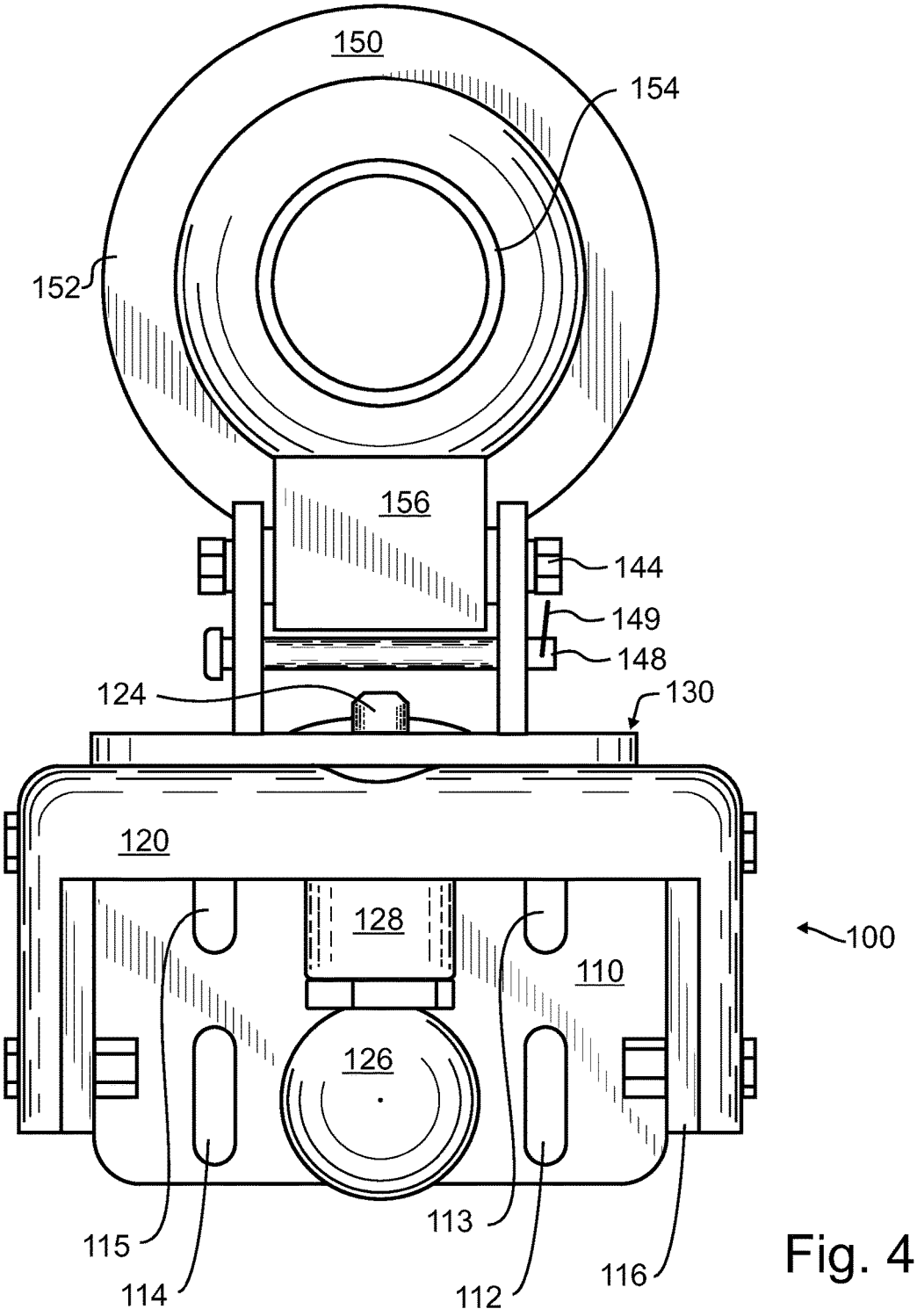
FIG. 4 illustrates the preferred embodiment transom mount of FIG. 1 from a rear elevational view.

While the particular affixing method is not critical to the present invention, in the preferred embodiment transom mounting bracket 110 is provided with four generally parallel transom mounting bolt slots 112, 113, 114, 115 illustrated for example in FIG. 4. These slots 112-115 allow a person to attach the transom mounting bracket 110 directly to a transom 2 using four bolts passing through transom mounting bracket 110 and also through transom 2. The slots 112-115 allow preferred embodiment transom mount 100 to be raised or lowered with respect to transom 2. This allows for a very low mount immediately adjacent to the gunwale, while also permitting preferred embodiment transom mount 100 to be raised relative to transom 2 to facilitate spinning a long shaft propeller into the boat, to allow a more conducive drive line angle, or for other desired or beneficial purposes. These different desired heights may be achieved without the need for additional holes through the transom.

If desired or where necessary or appropriate, additional reinforcement may also be provided adjacent to transom 2 on the side or face of transom 2 opposite to transom mounting bracket 110. For exemplary purposes, as illustrated in FIG. 1 transom mounting bracket 110 is mounted on the external, most aft or outboard face of the transom 2. In this alternative embodiment, a transom backing plate that has a hole pattern complimentary or cooperative with transom mounting bolt slots 112-115, and optionally of a size similar to that of transom mounting bracket 110, may be mounted on the inboard, fore, or bow side of transom 2. In this case, the bolts will pass through the transom backing plate, transom 2, and transom mounting bracket 110 to securely affix transom mounting bracket 110 to the transom 2. The transom backing plate simply provides additional strength and reinforcement to transom 2.

Figure 3:
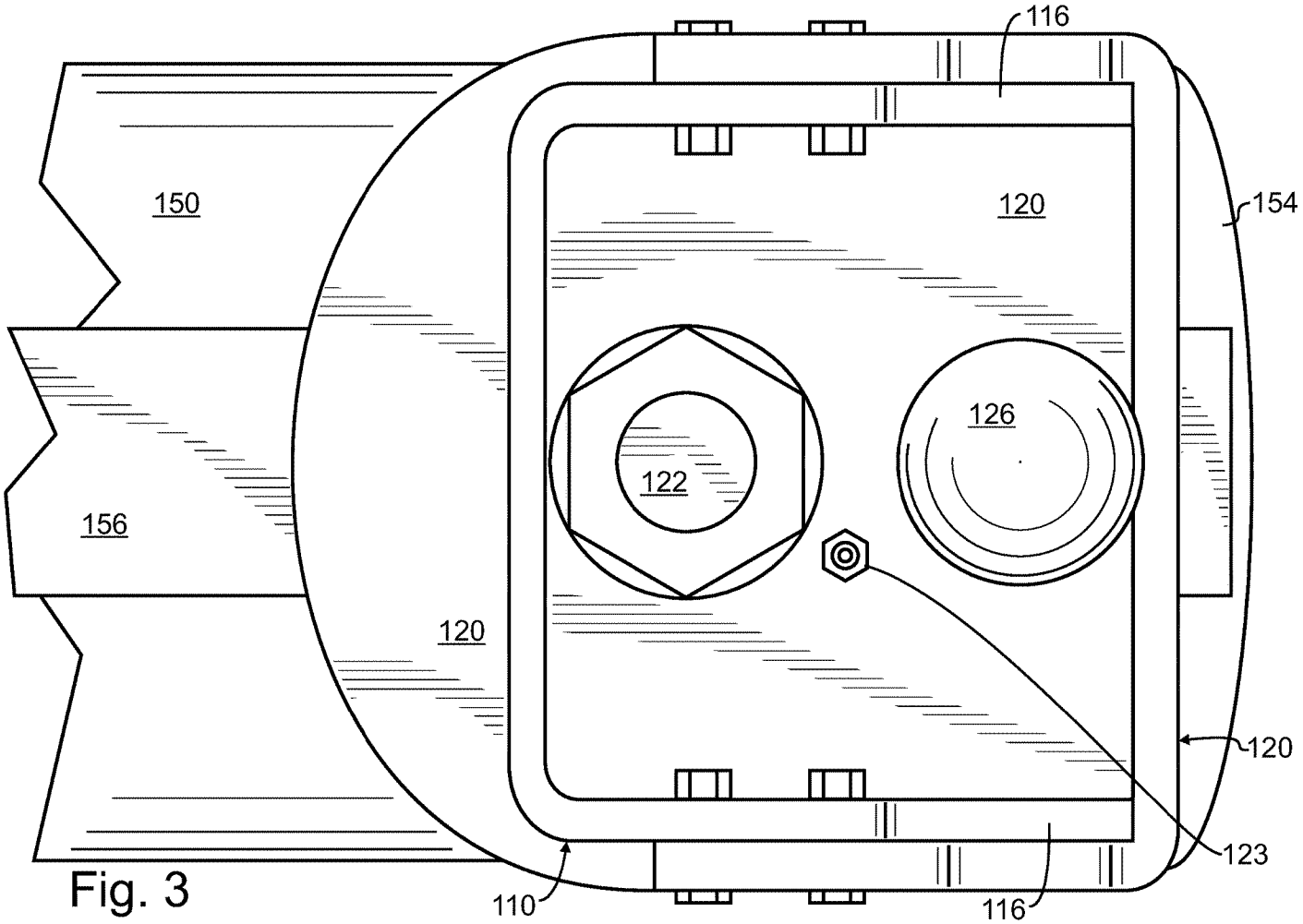
FIG. 3 illustrates the preferred embodiment transom mount of FIG. 1 from a bottom plan view, enlarged about the bottom of the transom mount.

As noted herein above, the particular construction and geometry of a hull and transom 2 varies among different boats. However, most preferably the axis of rotation of bell housing 150, engine, and long shaft 160 will be vertical, the benefit which will be described herein below. Consequently, the angle of a particular transom 2 is compensated for through the provision of a leveling platform 120. As best illustrated in FIG. 3, transom mounting bracket 110 when viewed from the bottom has a general U-shape, having a flat surface that is affixed to transom 2, and two ears 116 extending perpendicularly therefrom. Each ear is provided with an arcuate slot 118 visible in FIG. 1, and an angle setting fastener 123 such as a bolt with a Nylok™ nut passing through the arcuate slot 118. A single round hole may be provided in the leveling platform 120. Angle setting fastener 123 passes through this hole in the leveling platform 120 and also through arcuate slot 118 in the transom mounting bracket ear, and fastener 123 is tightened only after the angle between transom mounting bracket 110 and leveling platform 120 is appropriate to ensure that the axis of the pintle 122 illustrated in FIG. 3 is vertical or adequately vertical. In preferred embodiment transom mount 100, two additional fasteners 121, 125 are preferably provided. Pivot fastener 121 is simply provided to provide a pivot point between transom mounting bracket 110 and leveling platform 120. Triangular anchor fastener 125 works cooperatively with pivot fastener 121 and angle setting fastener 123 to provide great strength and securement through the triangular configuration of fasteners.

Pintle 122 provides a rotary coupling between leveling platform 120 and carousel 130. The particular bearing structure used within pintle 122 is not critical to the present invention, and so may include any structure suited for a marine environment. In the preferred embodiment, a grease fitting 123, also commonly referred to as a grease zerk, is provided adjacent to the pintle 122 structure, to allow periodic lubrication.

On the top of carousel 130 are a pair of long shaft drive supporting plates 140, and adjacent the top of each one of the long shaft drive supporting plates 140 is a hole having a bushing 142 therein. A long shaft drive horizontal pivot bolt 144 may preferably be provided that passes through this pair of holes, and also through a hole in pivot bar 156, located adjacent the lower portion of bell housing 150. While a bolt 144 is illustrated in the Figures, any suitable fastener including but not limited to a bolt or quick release pin may be provided. This long shaft drive horizontal pivot bolt 144 thereby defines a second rotational axis that permits bell housing 150 to pivot about a horizontal axis in the manner of a see-saw. A removable bolt or quick release pin is preferred, since it permits the engine, bell housing 150, and long shaft 160 to be quickly and easily removed from long shaft drive supporting plates 140 and carousel 130 for servicing, for selectively reversing the direction of bell housing 150 relative to carousel 130, and for other useful purposes. In the preferred embodiment, transom mounting bracket 110 is securely affixed to transom 2 with four bolts. This method of attachment provides an added measure of safety, by not being removable or separable therefrom. In such case, the long shaft drive horizontal pivot is preferably removable, to facilitate separation and servicing of the long shaft drive train. However, any suitable bearing structure may be provided, whether permanent or, as in the case of the preferred embodiment, removable.

Figure 7:
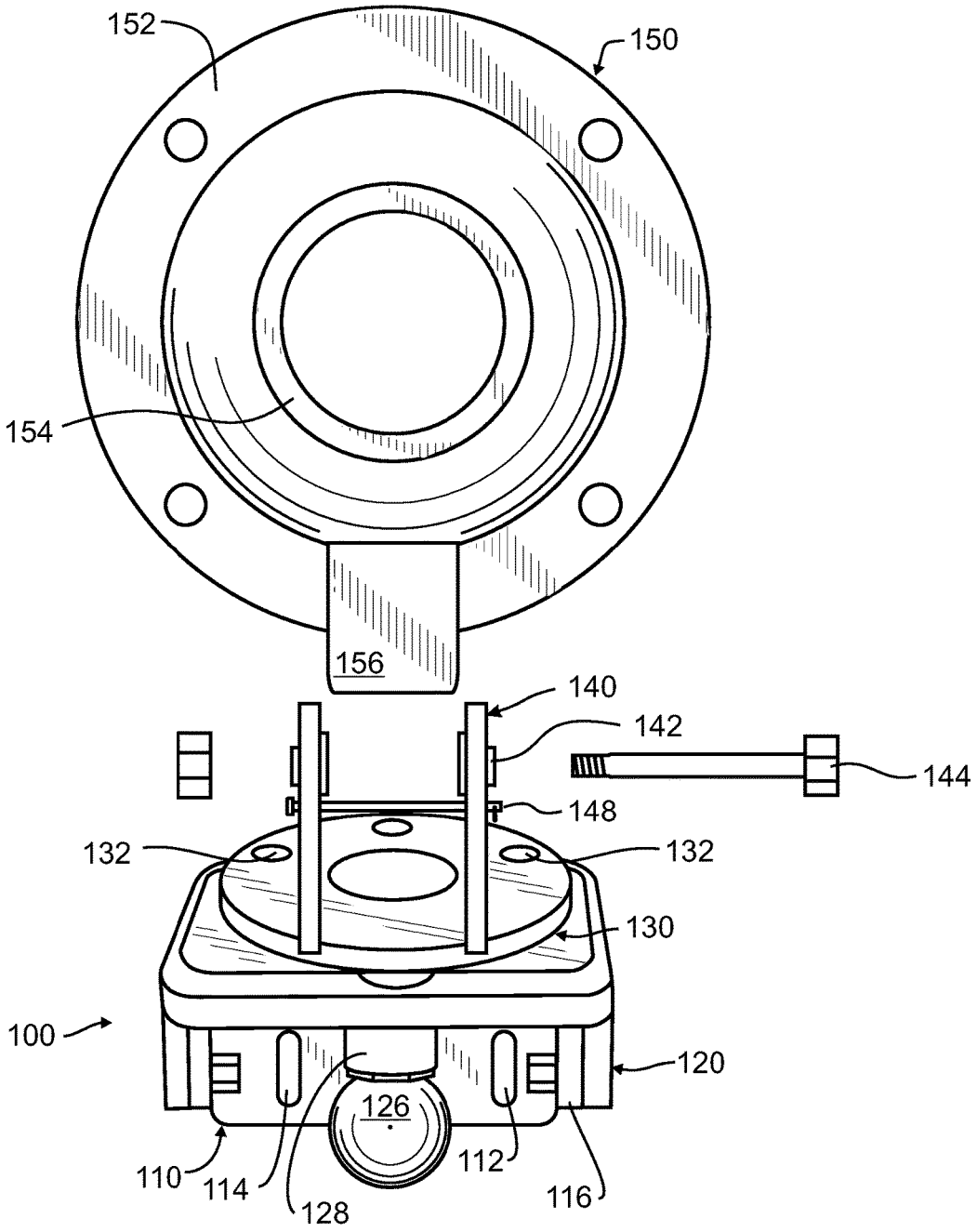
FIGS. 7-9 illustrate a method of reversing the bell housing to permit the transom mount to be moved from an exterior or outboard mount to an interior or inboard mount from a rear and projected view similar to that used in FIG. 6.
Figure 8:
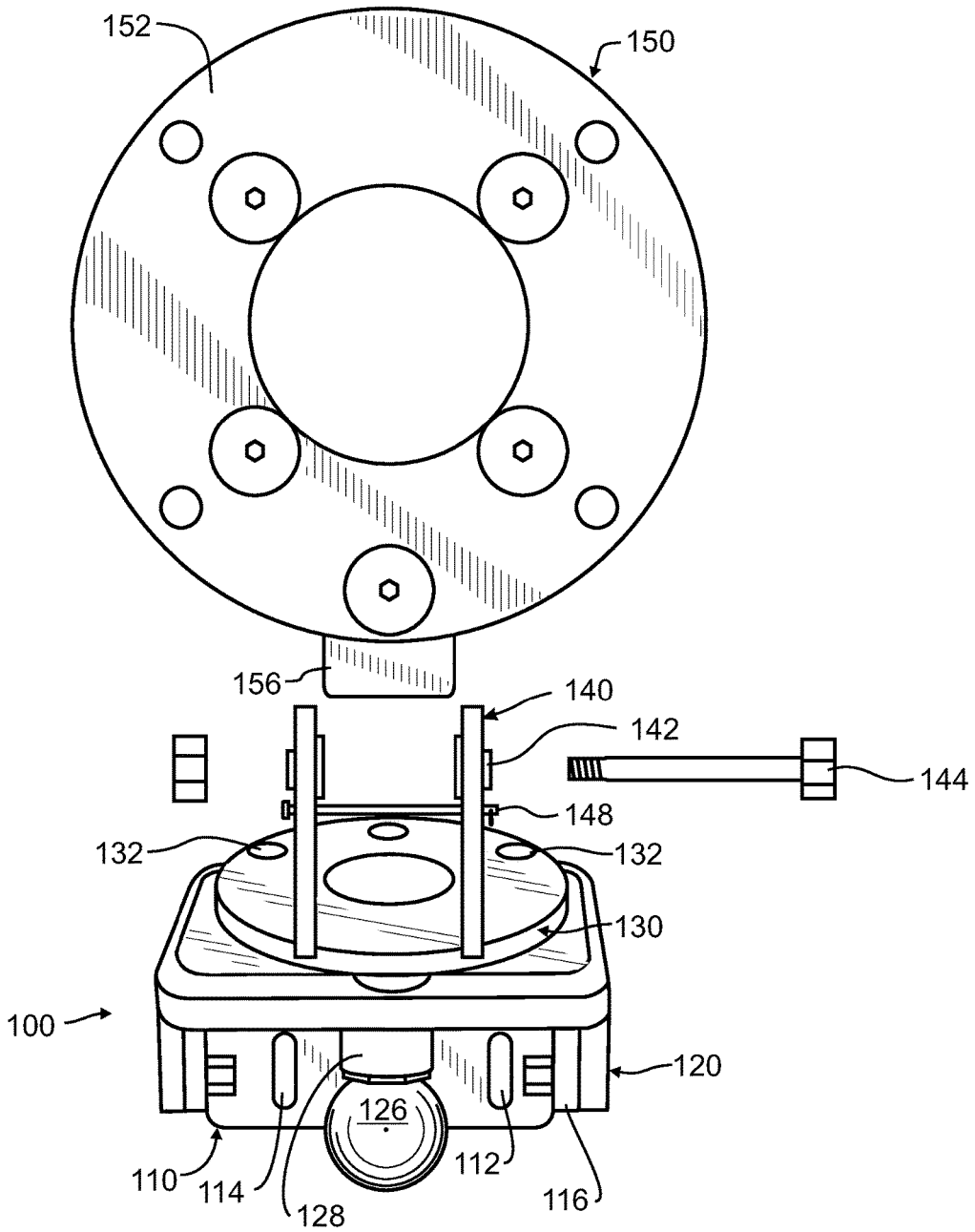

FIGS. 7 and 8 illustrate bell housing 150 separated from transom mount 100, by removing long shaft drive horizontal pivot bolt 144. Also visible in these figures are optional but preferred bushings 142 that allow the long shaft drive horizontal pivot bolt 144 or long shaft drive horizontal pivot quick release pin to spin about long shaft drive supporting plates 140 without consequential short term damage or wear.

Absent additional structure, carousel 130 would be free to rotate unrestricted about pintle 122. This would allow the engine and long shaft propeller 160 to rotate freely, which is in fact commonplace in prior transom mounts.

Figure 6:
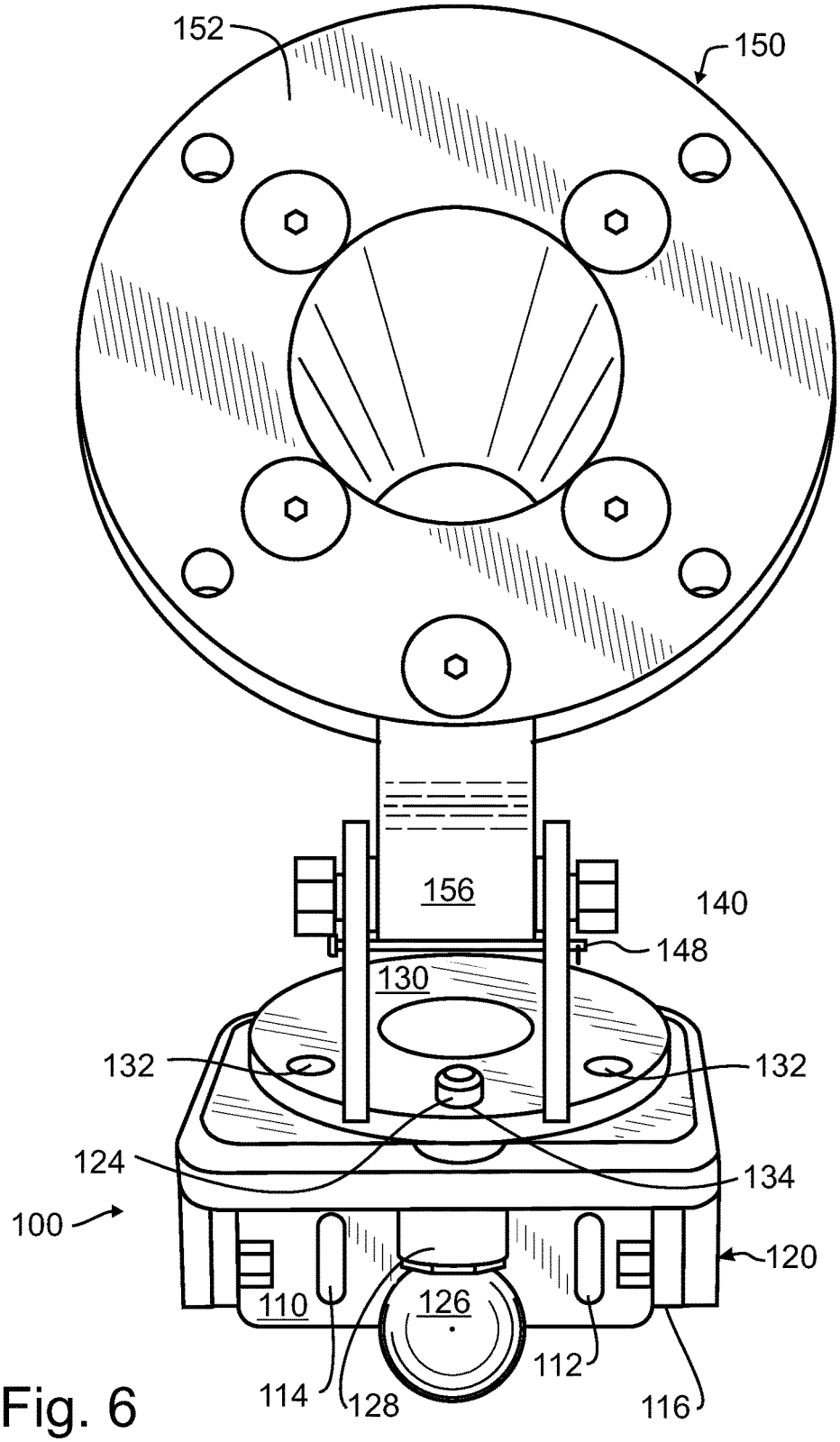
FIG. 6 illustrates the preferred embodiment transom mount of FIG. 1 from a rear and projected view similar to that used in FIG. 5, but with the bell housing rotated to a transport rotary lock position.

However, unlimited free rotation is not always desired. Certainly during operation, it is preferable to ensure that the propeller not be able to rotate all the way around and in to the boat. Yet, for transport the long shaft 160 will normally be stored within the boat, rather than being left extending out the back. Consequently, in the preferred embodiment transom mount 100 it is desirable to be able to selectively allow or prevent full rotation of the long shaft 160. Furthermore, when the long shaft 160 is being transported, it can be both difficult and inconvenient to secure long shaft 160 within the boat in a way that is both safe and secure. In order to overcome these limitation of the prior art, the present invention as best illustrated in FIG. 6 further incorporates a plurality of holes 132, 134 in carousel 130, and a spring pin knob 126 and spring pin 124 that are used to lock carousel 130 at various points of rotation about pintle 122. In the preferred embodiment illustrated in FIG. 6, three holes have been provided, though the particular number and placement of the holes may be varied to suit different applications and desires.

While not necessarily immediately evident from FIG. 6, spring pin 124 in these Figures passes through the center one of these three holes, the travel lock hole 134, and thereby locks long shaft propeller 160 inside and along the longitudinal center of the boat. This position is used for transport.

Within spring pin housing 128, as known in the art of spring pins, there is typically provided a compression spring that will push against a disc affixed to the spring pin shaft. This spring will thereby tend to urge spring pin 124 towards the carousel holes 132, 134, meaning if a person is not pulling against the spring, spring pin 124 will engage with the first hole that passes over spring pin 124. So, to move long shaft 160 to the transport position illustrated in FIG. 6, a person must pull on spring pin knob 126, which retracts spring pin 124 so that spring pin 124 will not engage with any of the carousel holes. Then the person will spin carousel 130 about pintle 122 until long shaft 160 is approaching the storage position. Preferably just before reaching the storage position rotation, the person will release spring pin knob 126, which allows the spring to drive spring pin 124 into the next hole in carousel 130, which will preferably be the center one of the three holes, travel lock hole 134.

In the preferred embodiment, there are no holes in the half of the carousel 130 closest to the long shaft 160. This is so that spring pin knob 126 may be left released during normal operation of the long shaft drive. The spring pin 124 will simply slide along the bottom of carousel 130 as carousel 130 rotates about pintle 122. However, in the event something extraordinary happens, and the long shaft 160 rotates beyond perpendicular to the boat to approximately 45 degrees from the storage position, then spring pin 124 will pass into one of the two rotary limit holes 132 on either side of the center travel lock hole 134. In other words, carousel 130 in the preferred embodiment may rotate freely through approximately 270 degrees, without spring pin 124 locking carousel 130. However, if carousel 130 rotates beyond, and a person is not simultaneously pulling on spring pin knob 126, spring pin 124 will engage with one of the rotary limit holes 132, which will stop long shaft 160 from rotating any farther. While in the preferred embodiment, approximately 270 degrees of free rotation is provided, it will again be understood that this choice is purely for exemplary purposes, and the angle selected by a designer may be varied therefrom to suit a particular need or design. Nevertheless, for most hulls this ability to point the propeller to within 45 degrees of the longitudinal axis will allow an operator great latitude using the propeller, without fear of harming the boat or anything contained within the hull.

The orientation of pintle 122 to a vertical position is preferred, since this allows spring pin 124 to operate in an easy and flawless manner while the long shaft 160 is rotated about, and without varying the tilt of the motor. In the preferred embodiment, if the pintle 122 axis is approximately vertical, while the motor will tilt about the horizontal axis defined by the long shaft drive horizontal pivot, it will not tilt about a horizontal axis perpendicular to the long shaft drive horizontal pivot. This ensures that oil stays in the appropriate places within the engine to ensure adequate lubrication.

Furthermore, if pintle 122 is not vertical and the engine and long shaft pivot along a horizontal axis perpendicular to the long shaft drive horizontal pivot, the this also means that when the operator is attempting a turn, the skag and other accessories such as a long shaft propeller controller described in U.S. Pat. No. 8,911,272 by several of the present inventors and incorporated herein above by reference will also be misaligned. This can lead to undesirable improper operation or failure of these components. By keeping pintle 122 vertical, operation of the long shaft drive is more comfortable for the operator; engine lubrication is ensured; and any skag or other accessory such as a long shaft propeller controller are also maintained in proper orientation.

Figure 2:
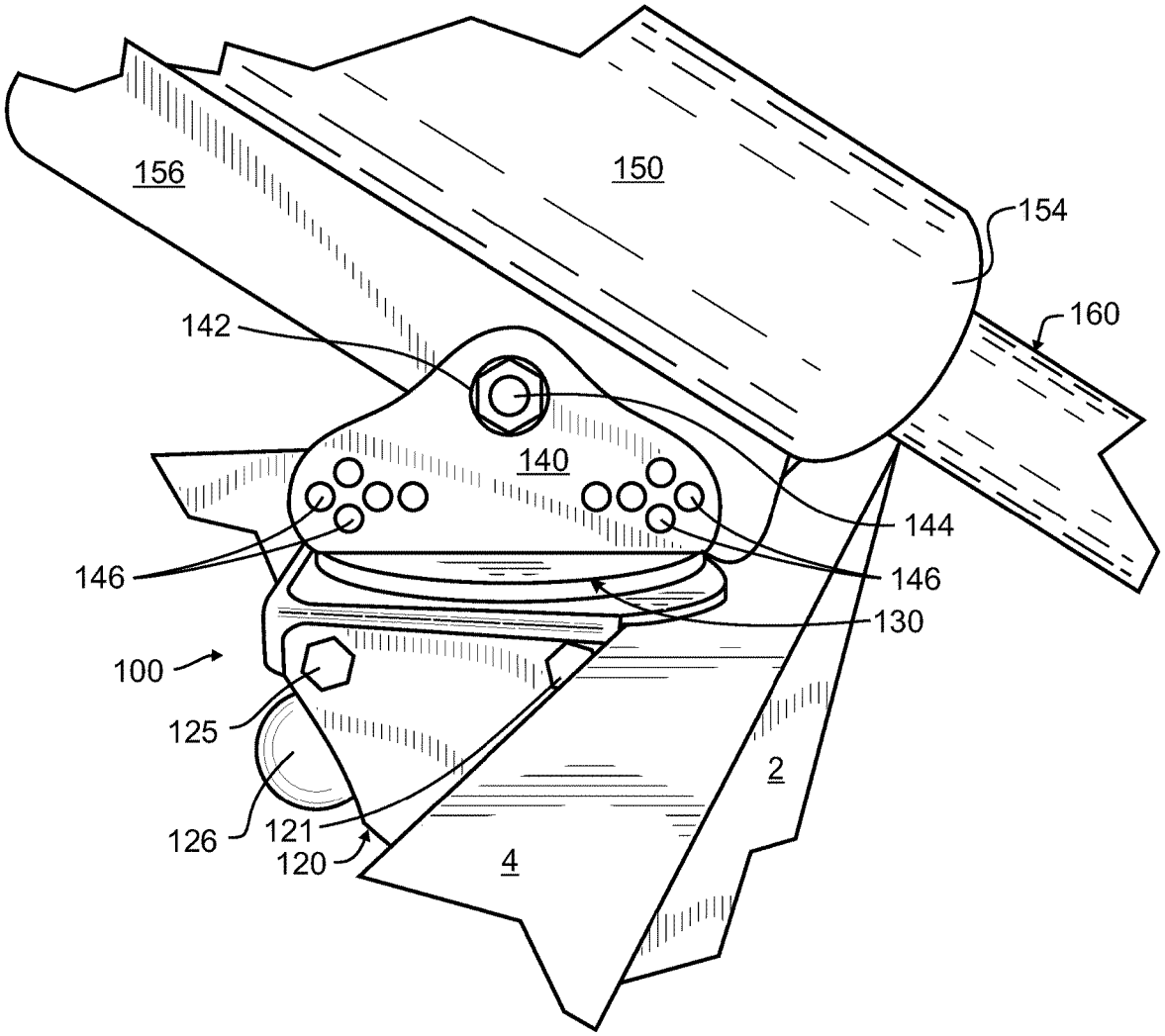
FIG. 2 illustrates the preferred embodiment transom mount in combination with a boat hull, transom, bell housing, and long shaft propeller of FIG. 1 but mounted inboard, to the bow or forward side of the transom from a side projected view.
Figure 5:
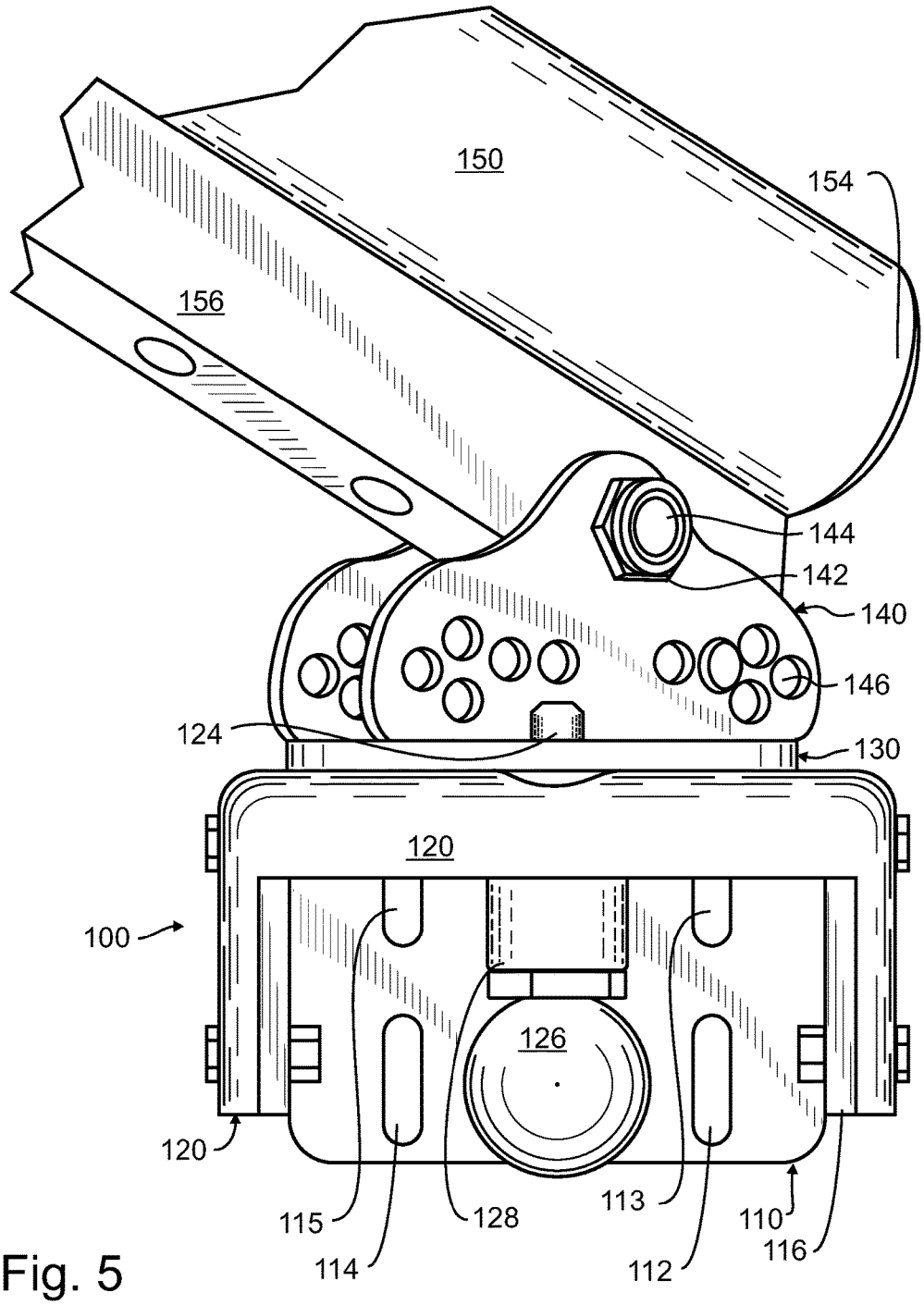
FIG. 5 illustrates the preferred embodiment transom mount of FIG. 1 from the same rear elevational view as used in FIG. 4, but with the bell housing rotated to a first rotary travel limit stop.

FIGS. 1, 2, and 5 additionally illustrate a plurality of tilt stop holes 146 and an exemplary tilt stop pin 148. In FIGS. 4 and 7, tilt stop pin 148 is retained with the aid of a cotter pin 149 passing through a hole in the end of the pin. As may be most evident from FIGS. 1 and 2, five tilt stop holes 146 are located on each side of long shaft drive horizontal pivot bolt 144. While the particular number and placement of tilt stop holes 146 may be varied to suit the needs and desires of a particular application, having a plurality of holes allows an operator to insert a tilt stop pin 148 through a particular hole set and to thereby select a maximum tilt angle in a direction of rotation. As illustrated, there is an angle change of approximately five degrees per hole. Two pins are required in order to set the maximum tilt in each direction of rotation, one fore of the pivot and the other pin aft. This can be used, for exemplary purposes, to set the maximum depth that the prop may reach, to set the height of the prop during transport, and for any other situation that requires a rotational limit about the long shaft drive horizontal pivot. If the orientation of pintle 122 is in a preferred approximate vertical position, this allows tilt stop pin 148 to set a reasonably reliable angular limit.

While a combination of tilt stop holes 146, tilt stop pin 148, and cotter pin 149 are illustrated in the preferred embodiment transom mount 100, it will be recognized herein that other techniques such as the use of a stopper ball or other rotational travel limits as known in the art may be used in alternative embodiments. Regardless of the apparatus used, limiting the tilt provides a number of advantages. With long shaft drives, when the boat is stuck or starting out, there is a tendency for the propeller to dive. The propeller can actually go under the boat if not limited, or drive into a lake or river bottom and become mired therein. Furthermore, when the engine is idling or unloaded, the propeller might otherwise tend to sink, and can impact obstacles. Ultimately then, the tilt limit helps to ensure an easier to operate, more enjoyable and safer long shaft drive system than heretofore available.

Noteworthy herein is the difference between long shaft drives and outboard motors. As already discussed herein above, outboard motors drive from below the bottom of the hull. Consequently, when an operator accelerates from a stop, the force from the prop will tend to lift or air the bow. As a result, persons familiar with outboard drives are also used to the bow lifting and dropping substantially. In contrast, long shaft drives push at the transom mount, which is at or near the top of the transom. Furthermore, the long shaft drive is also pushing from a much greater distance behind and in line with the boat hull. Consequently, when an operator accelerates using a long shaft drive, the drive will tend to keep the bow down, thereby maintaining a much more consistent transom angle relative to vertical irrespective of whether the operator is throttling or not.

Further special synergy arises through the use of a long shaft propeller controller described in U.S. Pat. No. 8,911,272 by several of the present inventors and incorporated herein above by reference. This is because the propeller controller described therein further maintains the propeller immediately adjacent to the water surface. This ensures that the propeller is running as high in the water as possible, or again more nearly in line with the boat hull. Since the present invention keeps the propeller controller properly oriented in the water, and thereby functioning properly, the two operate very synergistically together.

As noted herein above, various transoms and hulls may have very different geometries and dimensions. One of the features and advantages of the present invention is the ability to accommodate these widely varying designs. In addition to the ability to set rotational limits of bell housing 150 about the long shaft drive horizontal pivot axis and also of carousel 130 about the pintle axis, and to lock carousel 130 to a transport position, the mounting of the transom mounting bracket 110 may also be reversed on the transom 2. In other words, transom mount 100 may be mounted in an "outboard" position such as illustrated in FIG. 1, or may be reversed as illustrated in FIG. 2 so that the transom mounting bracket 110 is affixed to the bow or forward side of the transom 2. By mounting transom mount 100 on the bow side of transom 2, and when compared to mounting on the stern side, the position of pintle 122 will shift with respect to transom 2. Consequently, this can be used to either shorten (bow side of the transom 2) or extend (stern side) long shaft propeller 160 relative to the boat hull. As a result, the present invention is very adaptable to different hull designs, to enable the propeller to be positioned to avoid running in aerated water. In addition, when transom mount 100 is affixed in the inboard position illustrated in FIG. 2, this also shifts the weight of the long shaft drive assembly forward, which helps to balance the boat and keep the bow down. When transom mount 100 is affixed in the outboard position illustrated in FIG. 1, an operator can gain sharper turning capability in addition to the longer shaft, and the sternward shift of balance can help to air out the bow on boats that plow water.

Figure 9:
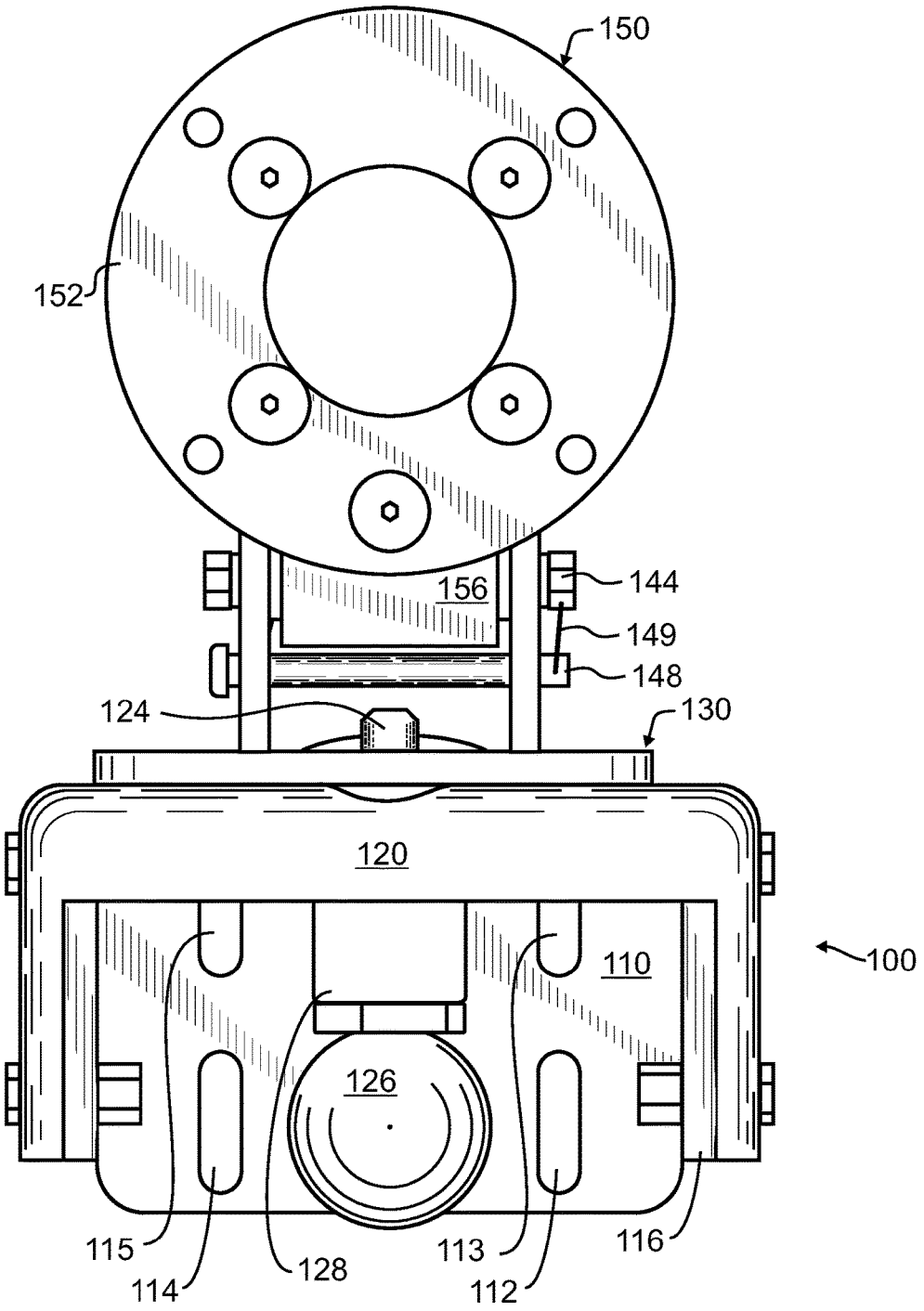

When transom mount 100 is positioned on the stern side of the transom 2 as in FIG. 1, then the three carousel holes that act as the travel lock hole 134 and rotary limit holes 132 will most preferably be located more nearly adjacent to the engine coupling flange 152 on bell housing 150. This is because, in the position shown in FIG. 1, spring pin 124 is in the more stern position that is adjacent to long shaft 160 when the long shaft drive is being used in normal forward drive position. As a result, the three holes would preferably be on the opposite side of carousel 130. However, if transom mount 100 is mounted on the bow side of transom 2, then spring pin 124 will also be in a fore or bow location, and the three carousel holes 132, 134 if left unchanged would lock the long shaft 160 when the long shaft 160 is pointing straight back. Consequently, when transom mounting bracket 110 is attached inboard, the holes need to be more nearly adjacent to long shaft 160 instead of the engine. In order to switch the carousel 130 orientation, to accommodate mounting either inboard or outboard, the long shaft drive horizontal pivot bolt 144 or quick release pin may be removed, carousel 130 simply rotated 180 degrees, and the long shaft drive horizontal pivot bolt 144 replaced. FIGS. 6-9 illustrate this method of reversing the bell housing 150 to permit transom mount 100 to be moved from an exterior or outboard mount of FIG. 1 to an interior or inboard mount of FIG. 2. In FIG. 7, bell housing 150 in the orientation of FIG. 6 has been released from the long shaft drive supporting plates 140 by removal of long shaft drive horizontal pivot bolt 144. In comparing FIG. 8 to FIG. 7, bell housing 150 has been reversed relative to carousel 130. Then long shaft drive horizontal pivot bolt 144 will be reinstalled, as illustrated in FIG. 9. This simple change ensures that transom mount 100 will still perform as intended, regardless of inboard or outboard mounting. The provision of tilt stop holes 146 on both sides of the long shaft drive horizontal pivot bolt 144 also ensures that the tilt stop pin can be used to set maximum depth regardless of whether preferred embodiment transom mount 100 is in the inboard configuration of FIG. 2 or the outboard configuration of FIG. 1.

The engagement of spring pin 124 in a rotary limit hole is illustrated in FIGS. 4-6. As may be apparent therein, and as noted here in above, the illustration of FIG. 5 is for an outboard transom mounting. As a result, the direction of the illustration of FIG. 5 is facing to the front or bow side of the boat. In the carousel 130 position as illustrated, the long shaft 160 is extending forward of the transom 2, and off to the starboard side of the boat. The spring pin 124 has engaged the rotary limit hole, so the long shaft 160 cannot be rotated any farther forward. This means that the rotary limit hole 132 and spring pin 124 together prevent the long shaft 160 from rotating into dangerous proximity with the boat hull. However, and as also noted herein above, if the operator were intentionally rotating the long shaft 160, such as for transport, then the operator need only pull on spring pin knob 126 to release the spring pin 124 from rotary limit hole 132, and then carousel 130 may be rotated further until spring pin 124 once again engages with a hole.

Various embodiments of apparatus designed in accord with the present invention have been illustrated in the various figures. The embodiments are distinguished by the hundreds digit, and various components within each embodiment designated by the ones and tens digits. However, many of the components are alike or similar between embodiments, so numbering of the ones and tens digits have been maintained wherever possible, such that identical, like or similar functions may more readily be identified between the embodiments. If not otherwise expressed, those skilled in the art will readily recognize the similarities and understand that in many cases like numbered ones and tens digit components may be substituted from one embodiment to another in accord with the present teachings, except where such substitution would otherwise destroy operation of the embodiment. Consequently, those skilled in the art will readily determine the function and operation of many of the components illustrated herein without unnecessary additional description.

Figure 10:
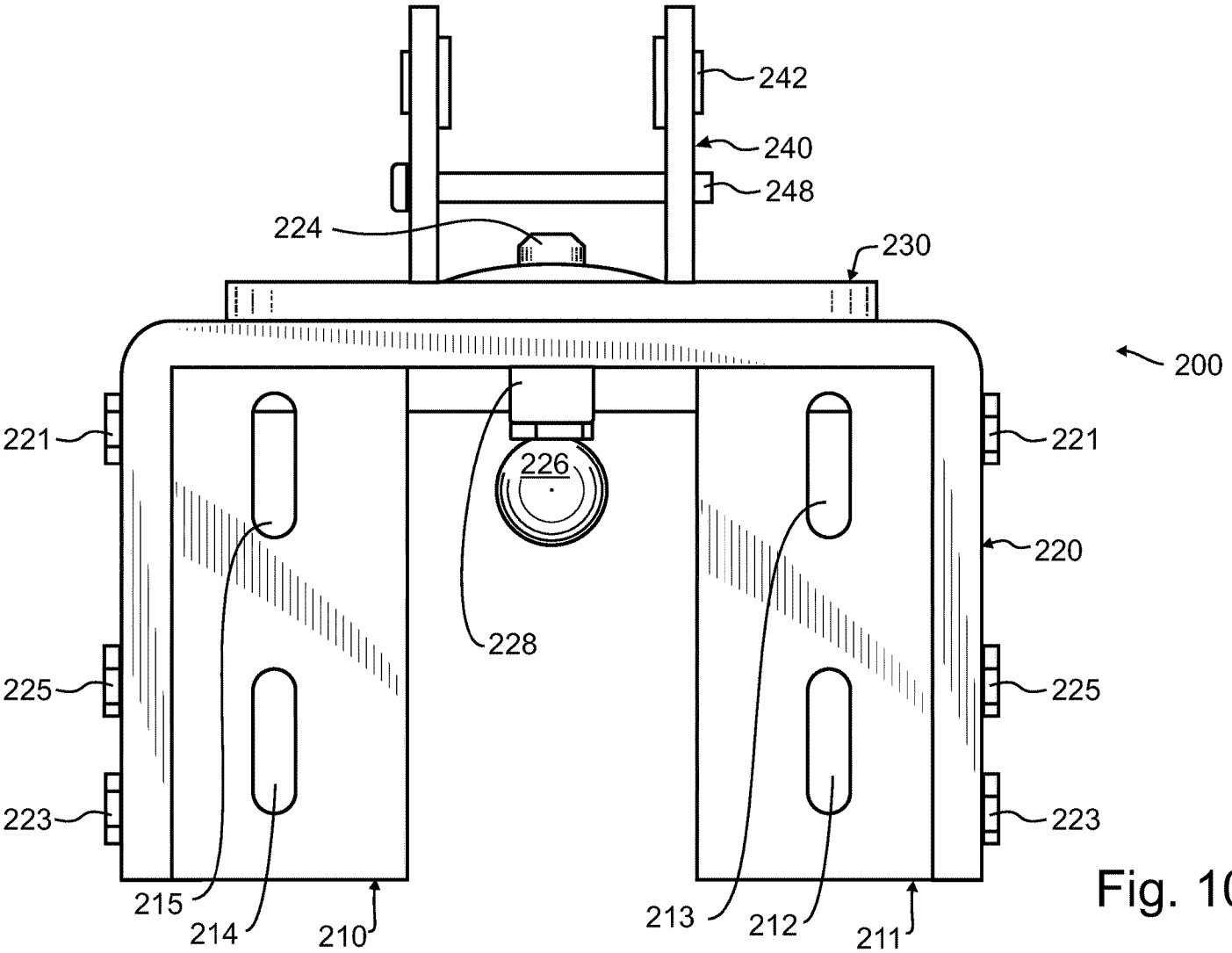
FIGS. 10-11 illustrate a first alternative embodiment transom mount from a front elevational view, and a bottom plan view, respectively.
Figure 11:
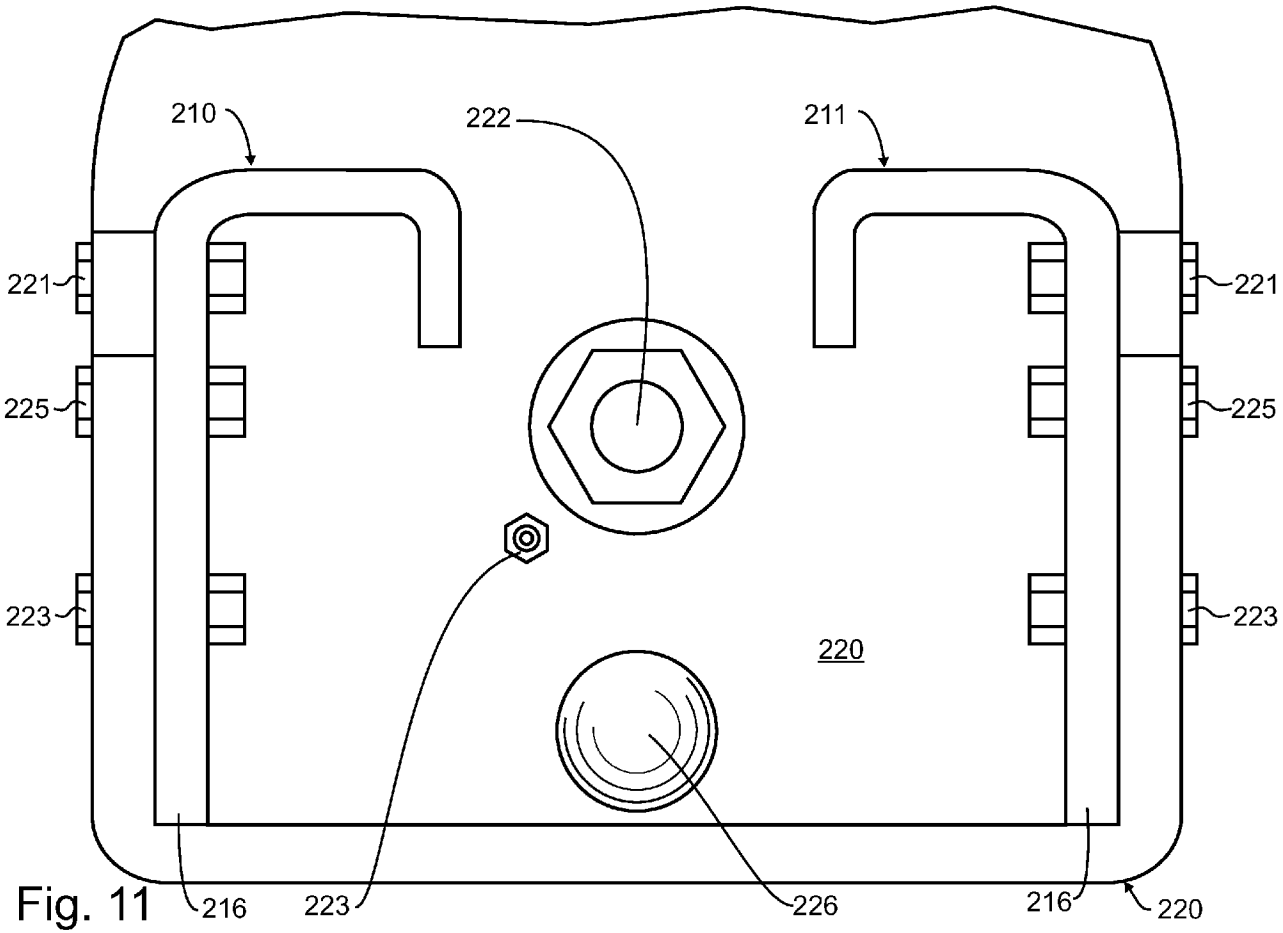
Figure 13:
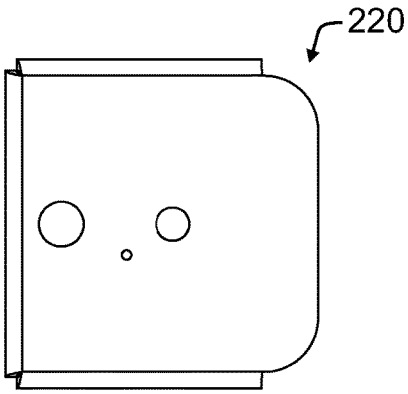
FIGS. 12-15 illustrate the first alternative embodiment leveling platform from projected, top, side and front views, respectively.
Figure 12:
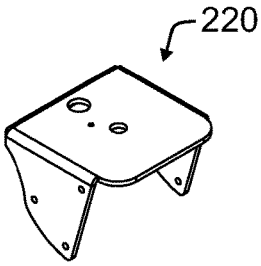
Figure 14:
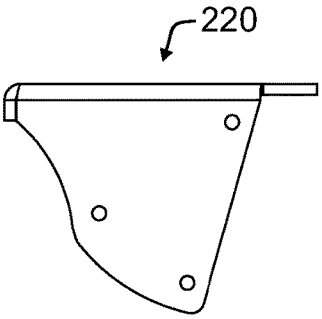
Figure 15:
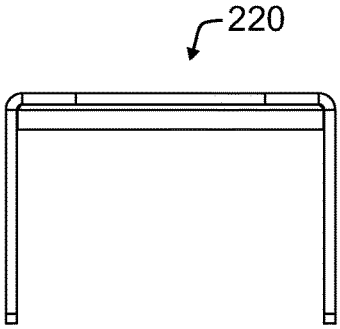
Figure 17:
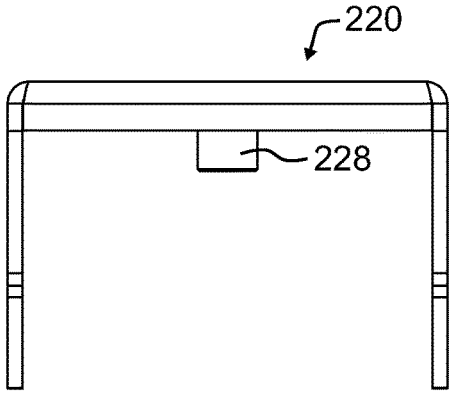
FIGS. 16-19 illustrate the first alternative embodiment leveling platform in further combination with a spring pin housing from projected, front, top, and side views, respectively.
Figure 16:
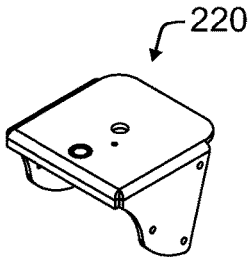
Figure 18:
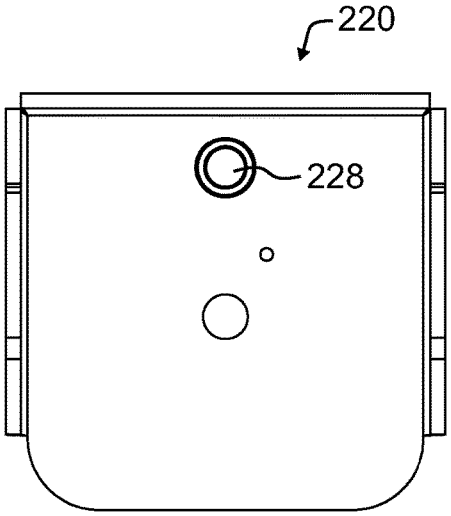
Figure 19:
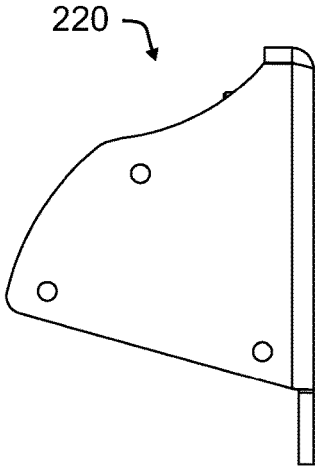
Figure 20:
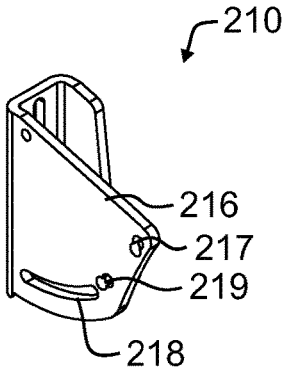
FIGS. 20-23 illustrate the first alternative embodiment left side transom mounting bracket from projected, top, front, and right side views, respectively.
Figure 21:
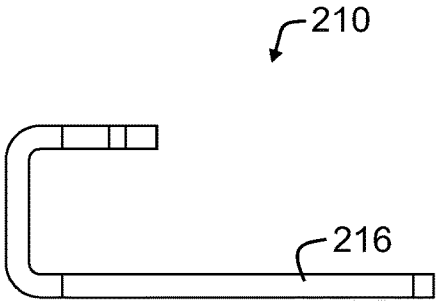
Figure 22:
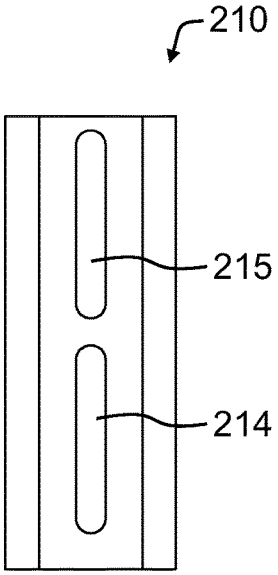
Figure 23:
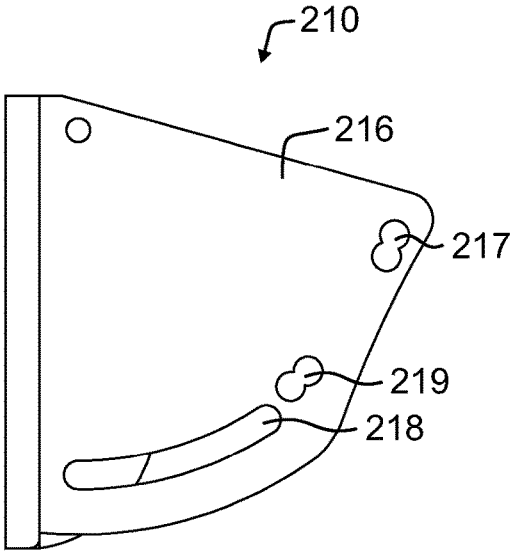
Figure 24:
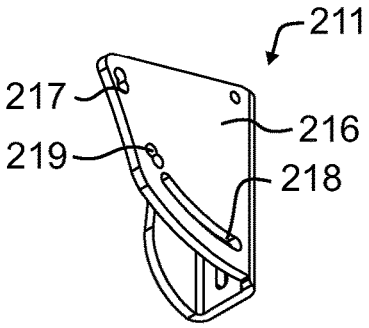
FIGS. 24-27 illustrate the first alternative embodiment right side transom mounting bracket from projected, bottom, front, and left side views, respectively.
Figure 25:
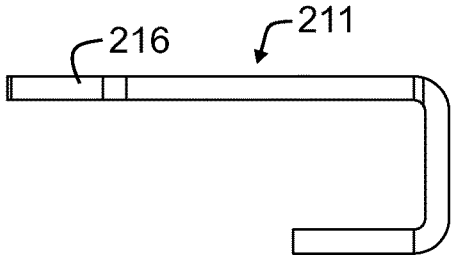
Figure 26:
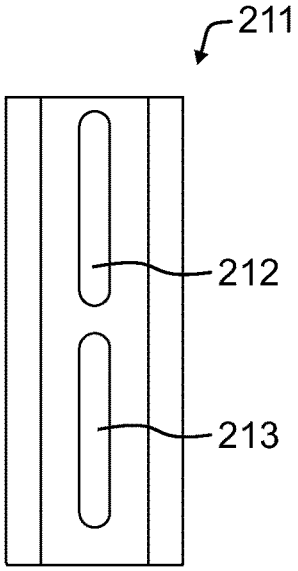
Figure 27:
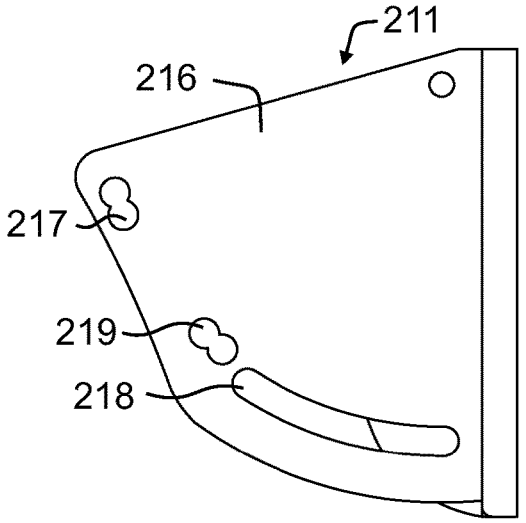

FIGS. 10-11 illustrate a fully-assembled first alternative embodiment transom mount 200. While the components are generally similar to that of the preferred embodiment of FIGS. 1-9, the transom mounting bracket 210 in this first alternative embodiment transom mount 200 has been divided into a left side transom mounting bracket 210 and a right side transom mounting bracket 211. One benefit of this divided transom mounting bracket is the formation of a gap there between. Some hull designs incorporate a knee brace rising from the bottom of the hull up towards the top of the transom 2, adjacent to gunwale 4. The open space between left side transom mounting bracket 210 and right side transom mounting bracket 211 accommodates this knee brace.

Figure 28:
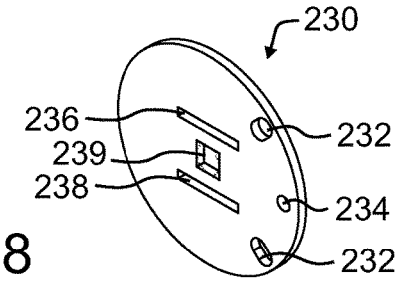
FIGS. 28-30 illustrate the first alternative embodiment carousel from projected, bottom plan, and side views, respectively.
Figure 29:
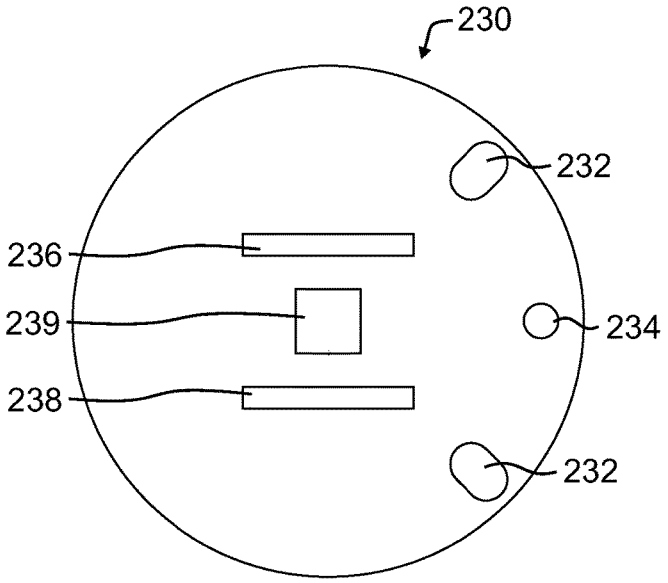
Figure 30:
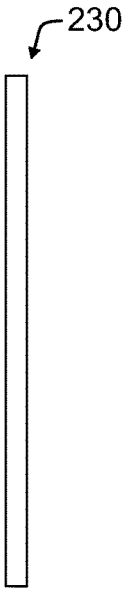
Figure 31:
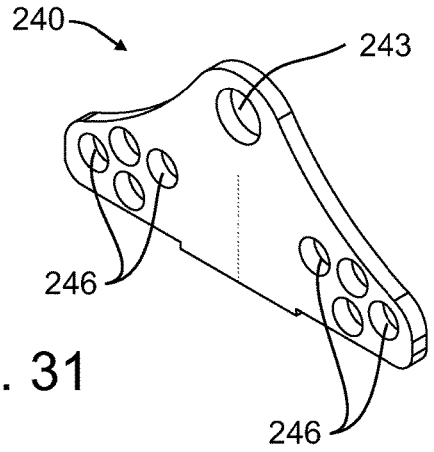
FIGS. 31-33 illustrate the first alternative embodiment long shaft drive supporting plate from projected, front, and side views, respectively.
Figure 33:
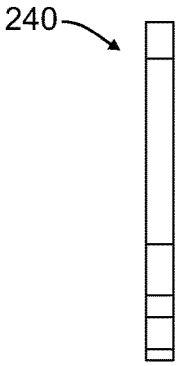
Figure 32:
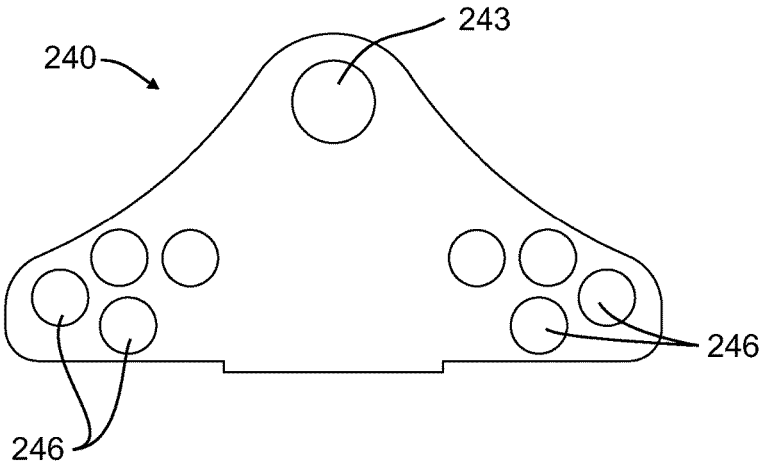
Figure 34:
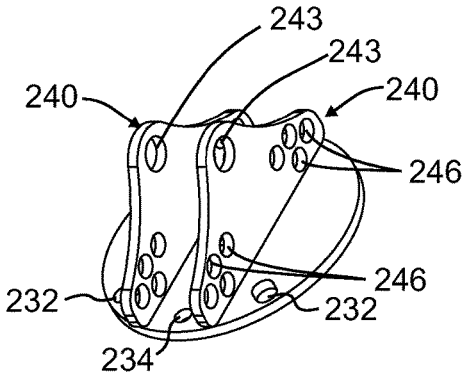
FIGS. 34-37 illustrate the first alternative embodiment carousel in combination with a pair of long shaft drive supporting plates from projected, front, side, and bottom plan views, respectively.
Figure 35:
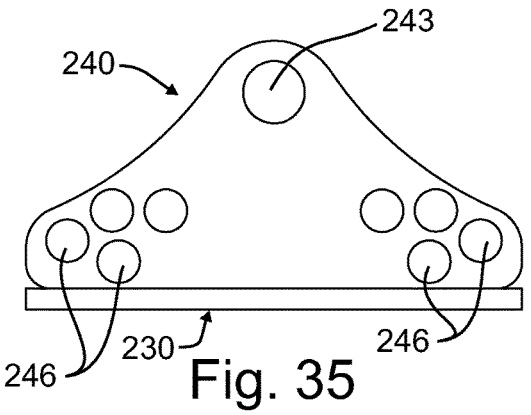
Figure 37:
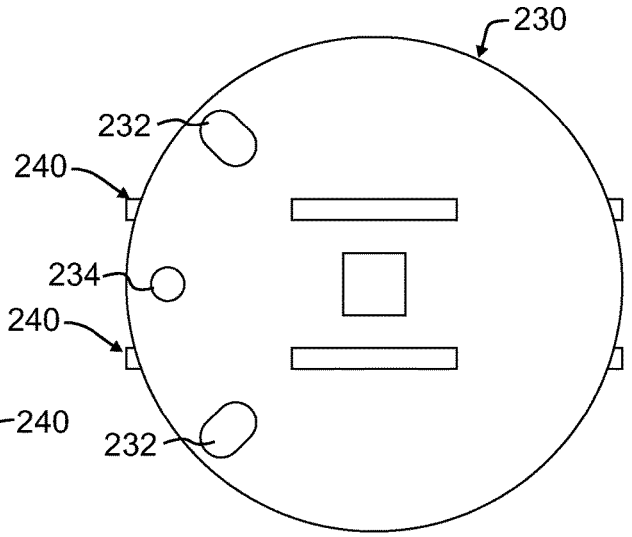
Figure 36:
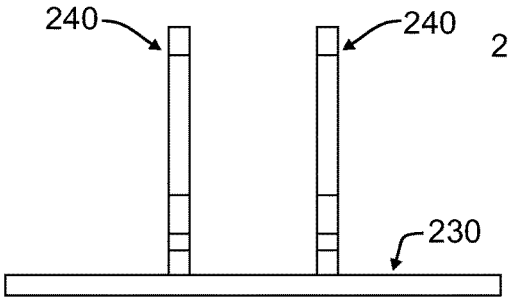

The various components of the first alternative embodiment transom mount 200 are illustrated as follows: FIGS. 12-15 illustrate the leveling platform 220; FIGS. 16-19 illustrate the leveling platform 220 in further combination with a spring pin housing 228; FIGS. 20-23 illustrate the left side transom mounting bracket 210; and FIGS. 24-27 illustrate the right side transom mounting bracket 211. In FIGS. 20, 23, 24, and 27, standard holes 217, 219 are provided in combination with arcuate slot 218. These holes are located for the standard and most common transom tilts of 12 and 16 degrees from vertical, by passing triangular anchor fastener 225 through one or the other of standard holes 217, 219, while angle setting fastener 223 will pass through arcuate slot 218. As is apparent, since triangular anchor fastener 225 and pivot fastener 221 are both passing though holes only, and not slots, when these positions are chosen there is no ability to incrementally adjust the angle. FIGS. 28-30 illustrate the carousel 230 with rotary limit hole 232 and travel lock holes 234. In addition, receiver notches 236, 238 are provided to receive the base of long shaft drive supporting plates 240 therein, while pintle receiver 239 provides a central opening for pintle 222. FIGS. 31-33 illustrate the long shaft drive supporting plates 240 with tilt stop holes 246; and FIGS. 34-37 illustrate the carousel 230 in combination with a pair of long shaft drive supporting plates 240 showing the combined assembly.

Figure 38:
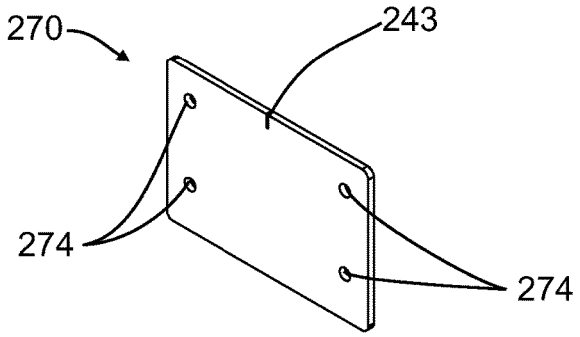
FIGS. 38-40 illustrate the first alternative embodiment backing plate from projected, front, and side views, respectively.
Figure 40:
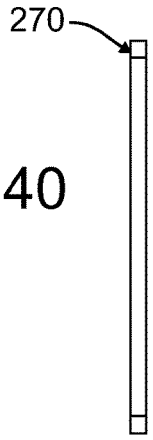
Figure 39:
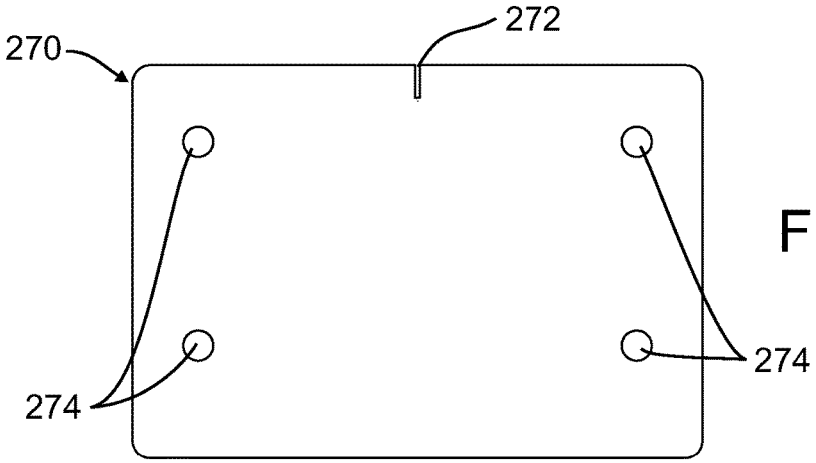

FIGS. 38-40 illustrate a backing plate 270 that can serve as both a template for hole drilling and which can provide desired reinforcement to a needy transom. The backing plate 270 illustrated in FIGS. 38-40 has already been discussed herein above with reference to the preferred embodiment, and provides reinforcement on the side of the transom 2 opposite to transom mount 200. In addition, backing plate 270 also acts as a template for drilling holes through the transom 2. The mounting holes 274 will preferably align with the transom mounting bolt slots 212, 213, 214, 215 on the leveling platform 220. In addition, a small alignment notch 272 may be provided to assist both with proper centering between port and starboard on the transom 2 and to facilitate height positioning as well.

Figure 41:
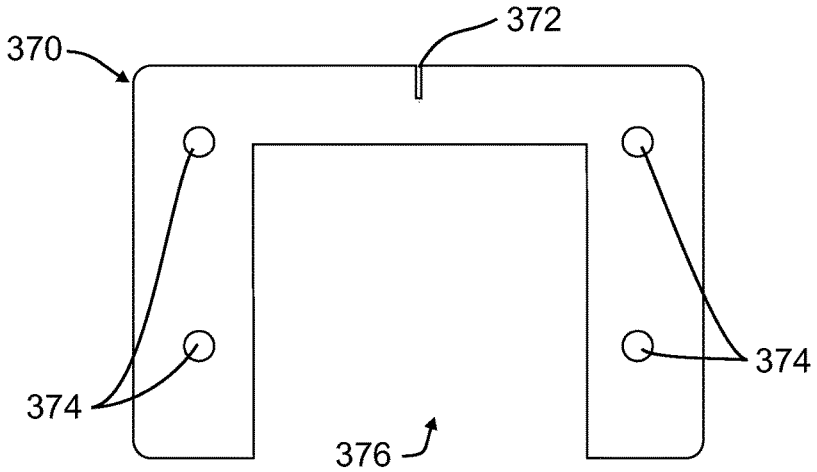
FIG. 41 illustrates a second alternative embodiment backing plate from a front elevational view similar to that of FIG. 39.

FIG. 41 illustrates another alternative embodiment backing plate 370, which is similar to backing plate 270, but which also includes a large opening 376 in the central region thereof. This large opening 376, similar to alternative embodiment transom mount 200, allows a knee bridge to run from the hull to the transom. When the template provided by backing plate 370 is used properly, one set of holes drilled in the transom work for both inboard and outboard mounting.

Figure 42:
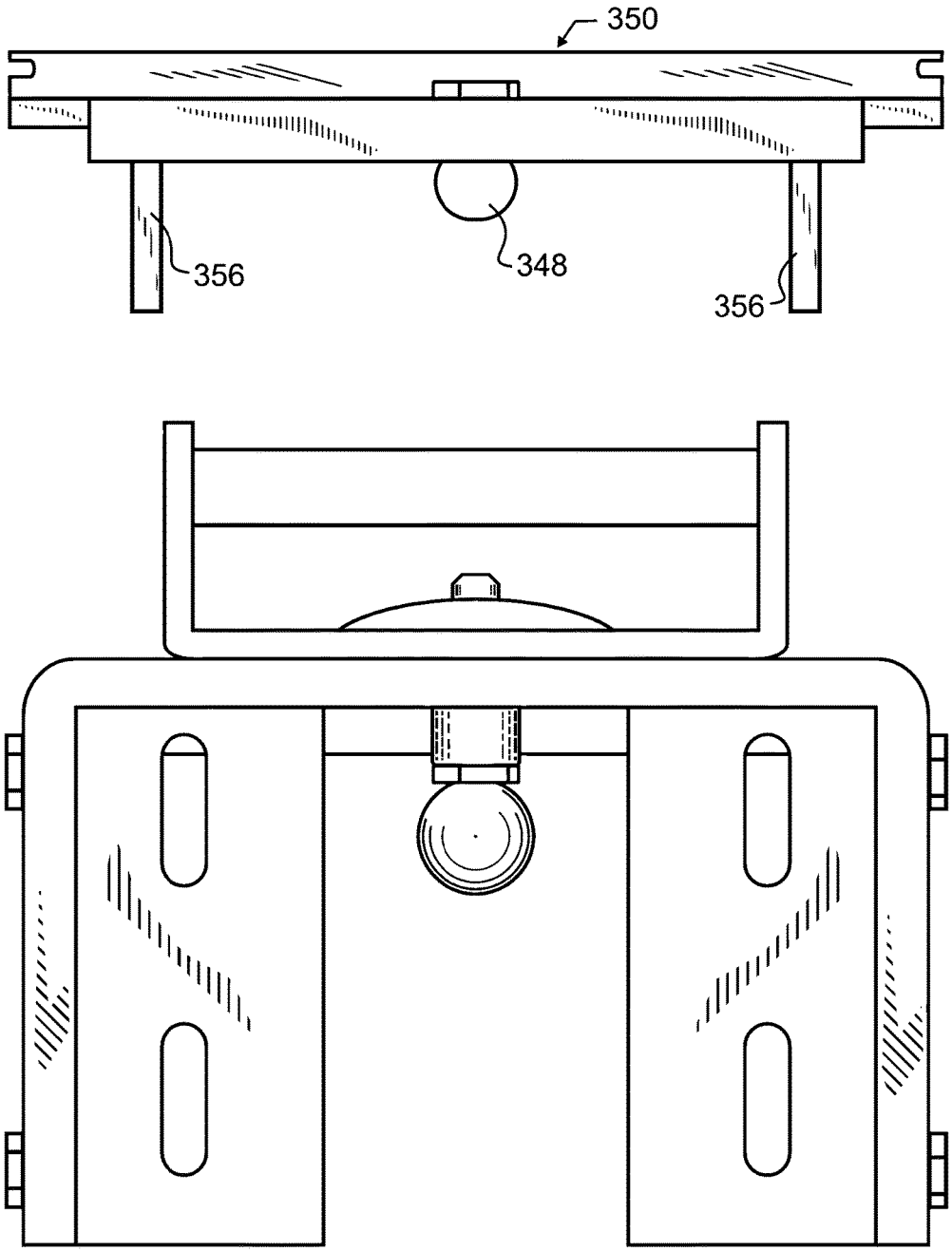
FIG. 42 illustrates a second alternative embodiment transom mount from a front elevational view.
Figure 43:
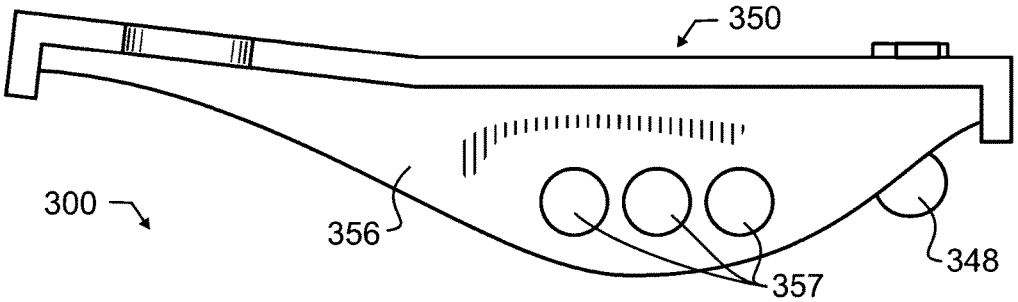
FIG. 43 illustrates the second alternative embodiment transom mount of FIG. 42 from a front elevational view, but with the carousel rotated.
Figure 43:
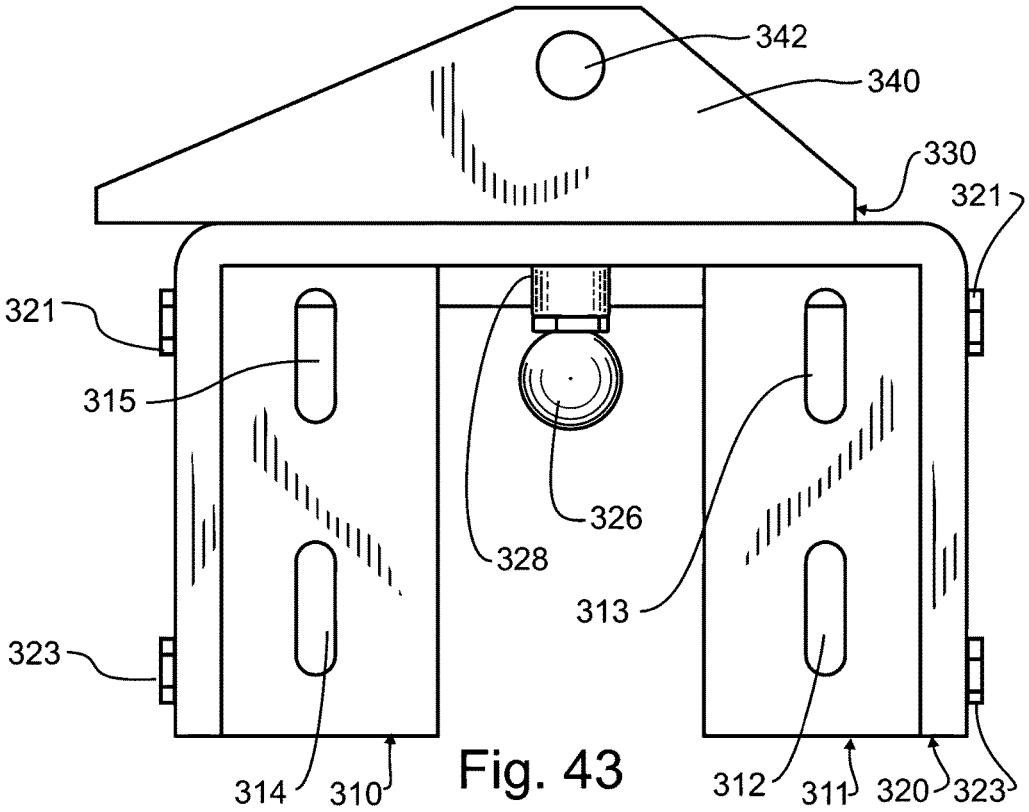

FIGS. 42 and 43 illustrate a second alternative embodiment transom mount 300 from a front elevational view, with the carousel rotated to two alternative positions for illustrative purposes. While the lower structure is similar to alternative embodiment transom mount 200, carousel 330 and long shaft drive supporting plates 340 have unique geometry. These Figures illustrate that the carousel and upper structure associated therewith may be adapted to accommodate different styles of long shaft drives and supporting structure 350, and so bell housing 150 is optional. In this embodiment, a tube 342 extends entirely between each of the two long shaft drive supporting plates 340. Two flanges 356 flank long shaft drive supporting plates 340. A suitable fastener such as a long shaft drive horizontal pivot bolt 144 or long shaft drive horizontal pivot quick release pin 145 will pass through tube 342 and one of the available set of holes 357, to thereby secure flanges 356 to plates 340.

While the foregoing details what is felt to be the preferred embodiment of the invention, no material limitations to the scope of the claimed invention are intended. Further, features and design alternatives that would be obvious to one of ordinary skill in the art are considered to be incorporated herein. The scope of the invention is set forth and particularly described in the claims herein below.

We claim:

1. An adjustable transom mount configured to support a shaft drive upon a boat transom, comprising:

a transom mounting bracket configured to affix to said boat transom;

a leveling platform affixed to and angularly adjustable relative to said transom mounting bracket;

a fastener selectively securing said leveling platform to said transom mounting bracket;

a pintle coupled to said leveling platform; and a carousel supported through said pintle onto said leveling platform, said carousel configured to support said shaft drive upon said pintle.

2. The adjustable transom mount of claim 1, wherein further comprising:

a pair of spaced apart shaft drive supporting plates supported on said carousel;

a bell housing having an engine coupling flange on a first end and a shaft coupler on a second end distal to said first end;

a shaft drive horizontal pivot coupling said pair of spaced apart shaft drive supporting plates to said bell housing.

3. The adjustable transom mount of claim 2, wherein said pair of spaced shaft drive supporting plates further comprise a plurality of tilt stop holes; and further comprising a tilt stop pin configured to pass through at least one of said plurality of tilt stop holes to limit a maximum tilt of said bell housing relative to said leveling platform.

4. The adjustable transom mount of claim 1, wherein said pintle further rotates about a substantially vertical axis.

5. The adjustable transom mount of claim 1, further comprising:

a spring pin;

at least one rotary limit hole through which said spring pin is configured to selectively pass and thereby limit rotation of said carousel; and a travel lock hole through which said spring pin is configured to selectively pass and thereby prevent rotation of said carousel.

6. The adjustable transom mount of claim 5, wherein said carousel spins freely about said pintle until said spring pin aligns with at least one of said at least one rotary limit hole and said travel lock hole, said spring pin configured to automatically lock said carousel relative to said leveling platform when said spring pin aligns.

7. In combination, a boat hull, a shaft drive, and a transom mount configured to support said shaft drive upon said boat hull, said boat hull having:

a transom;

said shaft drive having:

an engine, a shaft propeller, and a pivotal support generally balanced between said engine and said shaft propeller;

said transom mount having:

a transom mounting bracket configured to affix to said boat transom a leveling platform angularly adjustable relative to said transom mounting bracket;

a fastener selectively securing said leveling platform to said transom mounting bracket;

a pintle coupled to said leveling platform; and a carousel supported through said pintle onto said leveling platform, said carousel and said pintle supporting said shaft drive upon said leveling platform.

8. The combination boat hull, shaft drive, and transom mount of claim 7, further comprising:

a pair of spaced apart shaft drive supporting plates supported on said carousel;

a shaft drive horizontal pivot support supported by said pair of spaced apart shaft drive supporting plates; and a bell housing having an engine coupling flange on one end and a shaft coupler on the other pivotally coupled by said shaft drive horizontal pivot support to said pair of spaced apart shaft drive supporting plates.

9. The combination boat hull, shaft drive, and transom mount of claim 8, further comprising:

a plurality of tilt stop holes; and a tilt stop pin configured to pass through at least one of said plurality of tilt stop holes to limit a maximum tilt of said bell housing relative to said leveling platform.

10. The combination boat hull, long shaft drive, and transom mount of claim 7, wherein said pintle further rotates about a substantially vertical axis.

11. The combination boat hull, shaft drive, and transom mount of claim 7, further comprising:

a spring pin;

at least one rotary limit hole through which said spring pin is configured to selectively pass and thereby limit rotation of said carousel; and a travel lock hole through which said spring pin is configured to selectively pass and thereby prevent rotation of said carousel.

12. The combination boat hull, shaft drive, and transom mount of claim 7, wherein said carousel spins freely about said pintle until said spring pin aligns with at least one of said at least one rotary limit hole and said travel lock hole, said spring pin configured to automatically lock said carousel relative to said leveling platform when said spring pin aligns.

13. A transom mount, comprising:

a transom mounting bracket;

a leveling platform angularly adjustable relative to said transom mounting bracket and supporting a pintle and a spring pin;

a carousel supported through said pintle onto said leveling platform and having rotary limit holes and a travel lock hole, and configured to generally spin freely about said pintle;

said spring pin configured to automatically lock said carousel relative to said leveling platform when aligned with said rotary limit and travel lock holes;

a pair of spaced apart shaft drive supporting plates supported on said carousel and through a shaft drive horizontal pivot supporting a bell housing having an engine coupling flange on one end and a shaft coupler on another end distal to said one end.

14. The adjustable transom mount of claim 13, further comprising:

a plurality of tilt stop holes in said pair of spaced apart shaft drive supporting plates; and a tilt stop pin configured to pass through at least one of said plurality of tilt stop holes and thereby limit a maximum tilt of said bell housing and shaft drive relative to said pair of spaced apart shaft drive supporting plates.

* * * * *